US007879212B2

(12) United States Patent
Yemini et al.

(10) Patent No.: US 7,879,212 B2
(45) Date of Patent: Feb. 1, 2011

(54) PEPTIDE NANOSTRUCTURE-COATED ELECTRODES

(75) Inventors: Miri Yemini, Tel-Aviv (IL); Meital Reches, RaAnana (IL); Judith Rishpon, Rechovot (IL); Ehud Gazit, Ramat-HaSharon (IL)

(73) Assignee: Ramot at Tel-Aviv University Ltd., Tel-Aviv (IL)

( * ) Notice: Subject to any disclaimer, the term of this patent is extended or adjusted under 35 U.S.C. 154(b) by 1078 days.

(21) Appl. No.: 11/591,613

(22) Filed: Nov. 2, 2006

(65) Prior Publication Data

US 2007/0138007 A1 Jun. 21, 2007

Related U.S. Application Data

(60) Provisional application No. 60/732,641, filed on Nov. 3, 2005.

(51) Int. Cl.
*G01N 27/327* (2006.01)

(52) U.S. Cl. ..... 204/403.01

(58) Field of Classification Search ..... 204/403.01–403.15; 205/777.5, 778, 792
See application file for complete search history.

(56) References Cited

U.S. PATENT DOCUMENTS 3,042,685 A 3/1962 Roussel
2,920,080 A 1/1965 Bucourt et al.
3,625,973 A 12/1971 Julia
3,790,596 A 2/1974 Shkilkova et al.
3,853,987 A 12/1974 Dreyer
3,867,517 A 2/1975 Ling
3,935,074 A 1/1976 Rubenstein et al.
3,976,639 A 8/1976 Batcho et al.
3,984,533 A 10/1976 Uzgiris
4,036,945 A 7/1977 Haber
4,299,917 A 11/1981 Berger et al.
4,331,647 A 5/1982 Goldenberg
4,626,540 A 12/1986 Capps et al.
4,666,828 A 5/1987 Gusella
4,801,531 A 1/1989 Frossard
4,816,567 A 3/1989 Cabilly et al.
4,873,316 A 10/1989 Meade et al.
4,925,673 A 5/1990 Steiner et al.
4,946,778 A 8/1990 Ladner et al.

(Continued)

FOREIGN PATENT DOCUMENTS

DE 3412445 10/1985

(Continued)

OTHER PUBLICATIONS

Kerman et al., "Peptide Nucleic Acid-Modified Carbon Nanotube Field-Effect Transistor for Ultra-sensitive Real-Time Detection of DNA Hybridization," NanoBiotechnology, vol. 1, No. 1, Mar. 2005.*

(Continued)

*Primary Examiner*—Alex Noguerola

(57) ABSTRACT

An electrode coated with peptide nanostructures, composed of self-assembled peptides, is disclosed. The electrode is capable of conducting a response current resulting from an electrochemical reaction. The electrode can form a part of an electrochemical cell, a detector and a sensor array. Methods utilizing an electrochemical cell, a detector or a sensor array comprising the electrode for detecting an Analyte in a sample and kits containing same are also disclosed.

48 Claims, 11 Drawing Sheets

U.S. PATENT DOCUMENTS

| | | | | |
|---|---|---|---|---|
| 4,970,233 | A | 11/1990 | McHugh | |
| 5,013,556 | A | 5/1991 | Woodle et al. | |
| 5,270,163 | A | 12/1993 | Gold et al. | |
| 5,272,057 | A | 12/1993 | Smulson et al. | |
| 5,304,470 | A | 4/1994 | Fischer et al. | |
| 5,332,648 | A | 7/1994 | Kihara et al. | |
| 5,475,096 | A | 12/1995 | Gold et al. | |
| 5,545,806 | A | 8/1996 | Lonberg et al. | |
| 5,545,807 | A | 8/1996 | Surani et al. | |
| 5,556,744 | A | 9/1996 | Weiner et al. | |
| 5,567,588 | A | 10/1996 | Gold et al. | |
| 5,569,825 | A | 10/1996 | Lonberg et al. | |
| 5,595,877 | A | 1/1997 | Gold et al. | |
| 5,625,126 | A | 4/1997 | Lonberg et al. | |
| 5,633,425 | A | 5/1997 | Lonberg et al. | |
| 5,637,459 | A | 6/1997 | Burke et al. | |
| 5,643,768 | A | 7/1997 | Kawasaki | |
| 5,658,754 | A | 8/1997 | Kawasaki | |
| 5,659,041 | A | 8/1997 | Pollak et al. | |
| 5,661,016 | A | 8/1997 | Lonberg et al. | |
| 5,683,867 | A | 11/1997 | Biesecker et al. | |
| 5,705,337 | A | 1/1998 | Gold et al. | |
| 5,916,642 | A | 6/1999 | Chang | |
| 5,977,302 | A | 11/1999 | Palmer et al. | |
| 6,110,590 | A | 8/2000 | Zarkoob et al. | |
| 6,162,828 | A | 12/2000 | Fukuda et al. | |
| 6,235,876 | B1 | 5/2001 | Palmer et al. | |
| 6,251,625 | B1 | 6/2001 | Bommarius et al. | |
| 6,255,286 | B1 | 7/2001 | Yanai et al. | |
| 6,261,569 | B1 | 7/2001 | Comis et al. | |
| 6,300,141 | B1 * | 10/2001 | Segal et al. | 435/287.1 |
| 6,303,567 | B1 | 10/2001 | Findeis et al. | |
| 6,309,669 | B1 | 10/2001 | Setterstrom et al. | |
| 6,326,174 | B1 | 12/2001 | Joyce et al. | |
| 6,359,112 | B2 | 3/2002 | Kapurniotu et al. | |
| 6,361,861 | B2 | 3/2002 | Gao et al. | |
| 6,376,233 | B1 * | 4/2002 | Wolf et al. | 435/288.4 |
| 6,472,436 | B1 | 10/2002 | Schubert et al. | |
| 6,593,339 | B1 | 7/2003 | Eek et al. | |
| 6,610,478 | B1 | 8/2003 | Takle et al. | |
| 6,613,875 | B1 | 9/2003 | Ghadiri | |
| 6,617,114 | B1 | 9/2003 | Fowlkes et al. | |
| 6,677,153 | B2 | 1/2004 | Iversen | |
| 6,689,753 | B1 | 2/2004 | Soto-Jara | |
| 6,762,331 | B2 | 7/2004 | Hong et al. | |
| 6,858,318 | B2 | 2/2005 | Kogiso et al. | |
| 6,976,639 | B2 | 12/2005 | Williams et al. | |
| 7,045,537 | B1 | 5/2006 | Woolfson et al. | |
| 7,491,699 | B2 | 2/2009 | Reches et al. | |
| 7,504,383 | B2 | 3/2009 | Gazit et al. | |
| 2001/0041732 | A1 | 11/2001 | Gurley et al. | |
| 2002/0006954 | A1 | 1/2002 | Hensley et al. | |
| 2002/0086067 | A1 | 7/2002 | Choi et al. | |
| 2002/0151506 | A1 | 10/2002 | Castillo et al. | |
| 2003/0130484 | A1 | 7/2003 | Gordon et al. | |
| 2003/0144185 | A1 | 7/2003 | McGimpsey | |
| 2003/0158237 | A1 | 8/2003 | Saragovi et al. | |
| 2003/0211007 | A1 * | 11/2003 | Maus et al. | 422/58 |
| 2003/0225155 | A1 | 12/2003 | Fernandez-Pol et al. | |
| 2004/0029830 | A1 | 2/2004 | Hebert | |
| 2004/0052928 | A1 | 3/2004 | Gazit | |
| 2004/0152672 | A1 | 8/2004 | Carson et al. | |
| 2004/0258726 | A1 * | 12/2004 | Stupp et al. | 424/423 |
| 2005/0069950 | A1 | 3/2005 | Haynie | |
| 2005/0124535 | A1 * | 6/2005 | McGimpsey | 514/9 |
| 2006/0079454 | A1 | 4/2006 | Reches et al. | |
| 2006/0079455 | A1 | 4/2006 | Gazit et al. | |
| 2006/0089380 | A1 | 4/2006 | Barnham et al. | |
| 2006/0089489 | A1 * | 4/2006 | Onizuka et al. | 530/329 |
| 2006/0194777 | A1 | 8/2006 | Gazit et al. | |
| 2006/0234947 | A1 | 10/2006 | Gazit | |
| 2007/0015813 | A1 | 1/2007 | Carter et al. | |
| 2007/0021345 | A1 | 1/2007 | Gazit | |
| 2007/0099840 | A1 | 5/2007 | Ulijn et al. | |
| 2007/0135334 | A1 | 6/2007 | Gazit | |
| 2007/0298043 | A1 | 12/2007 | Gazit et al. | |
| 2009/0061190 | A1 | 3/2009 | Gazit et al. | |
| 2009/0123553 | A1 | 5/2009 | Reches et al. | |
| 2009/0175785 | A1 | 7/2009 | Gazit et al. | |
| 2009/0263429 | A1 | 10/2009 | Ulijn et al. | |

FOREIGN PATENT DOCUMENTS

| | | |
|---|---|---|
| DE | 10043282 | 3/2002 |
| EP | 0081122 | 6/1983 |
| EP | 0421946 | 4/1991 |
| EP | 0885904 | 3/2004 |
| EP | 966975 | 7/2005 |
| EP | 1583713 | 10/2005 |
| FR | 1373316 | 9/1964 |
| JP | 59-044313 | 3/1984 |
| JP | 63-044895 | 2/1988 |
| JP | 02-295923 | 6/1990 |
| JP | 10-245342 | 9/1998 |
| JP | 2000-193661 | 7/2000 |
| WO | WO 80/00789 | 1/1980 |
| WO | WO 80/00789 | 5/1980 |
| WO | WO 92/19253 | 11/1992 |
| WO | WO 97/16191 | 9/1997 |
| WO | WO 98/20135 | 5/1998 |
| WO | WO 99/42102 | 8/1999 |
| WO | WO 99/58652 | 11/1999 |
| WO | WO 00/24390 | 4/2000 |
| WO | WO 00/50193 | 8/2000 |
| WO | WO 01/05421 | 1/2001 |
| WO | WO 01/10457 | 2/2001 |
| WO | WO 01/45726 | 6/2001 |
| WO | WO 01/49281 | 7/2001 |
| WO | WO 01/49307 | 7/2001 |
| WO | WO 01/93836 | 12/2001 |
| WO | WO 02/072086 | 9/2002 |
| WO | WO 02/094857 | 11/2002 |
| WO | WO 03/013442 | 2/2003 |
| WO | WO 03/024443 | 3/2003 |
| WO | WO 03/039540 | 5/2003 |
| WO | WO 03/063760 | 8/2003 |
| WO | WO 03/070269 | 8/2003 |
| WO | WO 03/077866 | 9/2003 |
| WO | WO 2004/050693 A1 * | 6/2004 |
| WO | WO 2004/052773 | 6/2004 |
| WO | WO 2004/060791 | 7/2004 |
| WO | WO 2005/016339 | 2/2005 |
| WO | WO 2005/020809 | 3/2005 |
| WO | WO 2005/027901 | 3/2005 |
| WO | WO 2005/031362 | 7/2005 |
| WO | WO 2005/085867 | 9/2005 |
| WO | WO 2006/006172 | 1/2006 |
| WO | WO 2006/018850 | 2/2006 |
| WO | WO 2006/020681 | 2/2006 |
| WO | WO 2006/027780 | 3/2006 |
| WO | WO 2006/013552 | 9/2006 |
| WO | WO 2007/029003 | 3/2007 |
| WO | WO 2007/043048 | 4/2007 |

OTHER PUBLICATIONS

Communication Pursuant to Article 94(3) EPC Dated Aug. 11, 2009 From the European Patent Office Re.: Application No. 05747261.5.

International Search Report Dated Jul. 19, 2004 From the International Searching Authority Re.: Application No. PCT/IL03/01045.

Office Action Dated Aug. 4, 2009 From the Israeli Patent Office Re.: Application No. 169120 and Its Translation Into English.

Response Dated Dec. 9, 2009 to Communication Pursuant to Article 94(3) EPC of Aug. 11, 2009 From the European Patent Office Re.: Application No. 05747261.5.

Response Dated Nov. 15, 2009 to Office Action of Jul. 14, 2009 From the Israeli Patent Office Re.: Application No. 169121.
Supplementary European Search Report Dated May 26, 2009 From the European Patent Office Re.: Application No. 05747261.
Changqing et al. "Amyloid-like Formation by Self-Assembly of Peptidolipids in Two Dimensions", Langmuir, 20: 8641-8645, 2004.
Ganesh et al. "Circular Dichroism and Fourier Transform Infrared Spectroscopic Studies on Self-Assembly of Tetrapeptide Derivative in Solution and Solvated Film", The Journal of Peptide Research: Official Journal of the American Peptide Society, 61(3): 122-128, Mar. 2003.
McPhee et al. "Engineered and Designed Peptide-Based Fibrous Biomaterials", Current Opinion in Solid State and Materials Science, 8(2): 141-149, Mar. 2004.
Rajagopal et al. "Self-Assembling Peptides and Proteins for Nanotechnological Applications", Current Opinion in Structural Biology, 002529297, 14(4): 480-486, Aug. 2004.
Ryadnow et al. "Engineering the Morphology of a Self-Assembling Protein Fibre", Nature Materials, 2(5): 329-332, May 2003.
Zhang "Fabrication of Novel Biomaterials Through Molecular Self-Assembly", Nature Biotechnology, 21(10): 1171-1178, Oct. 1, 2003.
Zhao et al. "Fabrication of Molecular Materials Using Peptide Construction Motifs", Trends in Biotechnology, 22(9): 470-476, Sep. 1, 2004.
International Search Report Dated May 10, 2004 From International Searching Authority Re.: Application No. PCT/IL2004/000012.
International Search Report Dated Aug. 16, 2005 From the International Searching Authority Re.: Application No. PCT/IL2004/000898.
Notice of Allowance Dated Sep. 16, 2008 From the US Patent Office Re.: U.S. Appl. No. 11/148,262.
Office Action Dated Sep. 15, 2008 From the Israeli Patent Office Re.: Application No. 169121 and Its Translation Into English.
Office Action Dated Sep. 15, 2008 From the Israeli Patent Office Re.: Appliction No. 169120 and Its Translation Into English.
Official Action Dated Dec. 3, 2008 From the US Patent and Trademark Office Re.: U.S. Appl. No. 10/574,405.
Official Action Dated Dec. 12, 2008 From the US Patent and Trademark Office Re.: U.S. Appl. No. 11/656,542.
Official Action Dated Dec. 16, 2008 From the US Patent and Trademark Office Re.: U.S. Appl. No. 10/562,852.
Written Opinion Not Dated From the International Searching Authority Re.: Application No. PCT/IL2004/000898.
Reza et al "Self-assembling Organic Nanotubes Based on a Cyclic Peptide Architecture", Nature 366:324-327 (1993).
Sano "Prevention of Alzheimer's Disease: Where We Stand", Current Neurology and Neuroscience Reports, 2(5): 392-399, Oct. 2002. Abstract.
Communication Pursuant to Article 94(3) EPC Dated Mar. 12, 2008 From the European Patent Office Re.: Application No. 05774727.1.
Communication Pursuant to Article 96(2) Dated Jul. 17, 2006 From the European Patent Office Re.: Application No. 03777149.0.
Communication Pursuant to Rules 109 and 110 EPC Dated Aug. 18, 2005 From the European Patent Office Re.: Application No. 04700494.0.
Examination Report Jan. 13, 2009 From the Government of India, Patent Office Re.: Application No. 1400/CHENP/2006.
International Preliminary Report of Patentability Dated Mar. 17, 2006 From the International Preliminary Examining Authority Re.: Application No. PCT/IL2004/000890.
International Preliminary Report on Patentability Jan. 22, 2009 From the International Bureau of WIPO Re.: Application No. PCT/IL2005/000954.
International Preliminary Report on Patentability Dated Mar. 1, 2007 From the International Bureau of WIPO Re.: Application No. PCT/IL2005/000902.
International Preliminary Report on Patentability Dated Apr. 13, 2006 From the International Bureau of WIPO Re.: Application No. PCT/IL2004/000898.
International Preliminary Report on Patentability Dated Feb. 15, 2007 From the International Bureau of WIPO Re.: Application No. PCT/IL2005/000589.
International Preliminary Report on Patentability Dated Jan. 22, 2009 From the International Bureau of WIPO Re.: Application No. PCT/IL2004/000577.
International Preliminary Report on Patentability Dated Apr. 24, 2008 From the International Bureau of WIPO Re.: Application No. PCT/IL2006/001174.
International Preliminary Report on Patentability Dated Jan. 25, 2007 From the International Bureau of WIPO Re.: Application No. PCT/IL2005/000754.
OA Feb. 1, 2009 W Sec 8, Israeli Office action.
OA of Jan. 8, 2009 W Sec 8, Israeli Office action.
Offical Action Dated Feb. 23, 2006 From the US Patent and Trademark Office Re.: U.S. Appl. No. 10/235,852.
Official Action Dated May 2, 2008 From the US Patent and Trademark Office Re.: U.S. Appl. No. 11/656,542.
Official Action Dated Apr. 3, 2009 From the US Patent Trademark Office Re.: U.S. Appl. No. 11/662,136.
Official Action Dated Apr. 10, 2009 From the US Patent and Trademark Office Re.: U.S. Appl. No. 11/386,880.
Official Action Dated Apr. 19, 2006 From the US Patent and Trademark Office Re.: U.S. Appl. No. 10/901,243.
Official Action Dated Sep. 19, 2007 From the US Patent and Trademark Office Re.: U.S. Appl. No. 11/148,262.
Official Action Dated Sep. 27, 2007 From the US Patent and Trademark Office Re.: U.S. Appl. No. 11/148,266.
Partial European Search Report and the European Search Opinion Dared Apr. 16, 2009 From the European Patent Office Re.: Application No. 09002048.8.
Response Dated May 25, 2007 to Communication Pursuant to Article 94(3) of Jan. 18, 2007 From the European Patent Office Re.: Application No. 04700494.0.
Supplementary European Search Report Dated Apr. 18, 2006 From the European Patent Office Re.: Application No. 03704977.2.
Asghamejad "Ester Derivatives as Prodrugs", Transport Processes in Pharmaceutical Systems, 102: 186, 2000.
Patani et al. "Bioisosterism: A Rational Approach in Drug Design", Chemical Reviews, 96(8): 3147-3176, 1996.
Nakajima "Amine Precursor Therapy: Manipulation of Brain Amine Activity With Precursor Amino Acid", Psychiatry and Clinical Neurosciences, 51(5), 267-274, 1997. p. 269, col. 1, § 2, 3.
Lee et al. "Anti-Diabetic Constituent From the Node of Lotus Rhizome (Nelumbo Nucifera Gaertn)", Natural Product Sciences, 7(4), 107-109, 2001. p. 108, col. 1; Last §-col. 2, § 1.
Honma et al. "Use of A Thromboxane A2 Antagonist or Synthase Inhibitor for Treating Central Nervous System Diseases, e.g. Alzheimer Type Dementia." Database WPI, Section Ch. Week 200039, Derwent Publications, AN 2000-451668. & WO 00/30683 (Yagami et al.), Jun. 2, 2000. Abstract.
Losert et al. "Effect of Indole 3 Alkanecarboxylic Acifs on Glucose Utilization in Rats" Arzneimittel-Forschung/Drug Research, 25(6): 880-887, 1975. p. 880, col. 1, § 6, p. 886, col. 2, § 4, 5, p .887, col. 1, § 3.
Kiselev "Pharmaceutical Composition for Prophylaxis and Treatment of Uterus Cervix Dysplasia and Cancer and Larynx Papillomatosis and Methods of Prophylaxis and Treatment of Said Sicknesses Based on Thereof", Database WPI, Section Ch, Week 200328, Derwent Publications, AN 2003-286683 & RU 2196568 C1 (Kiselev) Jan. 20, 2003. Abstract.
Kon-Ya et at "Indole Derivatives as Potent Inhibitors of Larval Settlement by the Barnacle, Balanus Amphitrite", Bioscience Biotechnology Biochemistry, JP, 58(12): 2178-2181, 1994. Compound 102.
Appukkuttan et al. "Microwave Enhanced Formation of Electron Rich Arylboronates", Synlett, 8: 1204-1206, 2003. Figs. Scheme 4, Compounds 5A, 5B, 5C, 5D.
Beugelmans Database Crossfire Beilstein [Online], Beilstein Institut zur F?rderung der Chemischen Wissenschaften, Frankfurt am Main, DE, Database Accession No. 116671 (BRN) Compounds INDOL-2-YL-Methanol & Beugelmans R.: Bulletin de la Soci?t? Chimique Fran?aise, p. 335-336, 1969.

Cohen et al "Inhibition of Amyloid Fibril Formation and Cytotoxicity by Hydroxyindole Derivatives", Biochemistry, 45: 4727-4735, 2006. Abstract, p. 4728, col. 1, Last §, p. 4728, co1. 2, § 2, Fig.1, p. 4729, co1. 1, p. 4728, col. 1 , Last §, p. 4728, col. 2, § 2, Fig.1, p. 4728, col. 1, Last §, p. 4728, co1. 2, § 2, Fig.1, 4, p. 4732, col. 2, § 2,3, p. 4733, col. 2, § 4.
Altland et al. "Potential Treatment of Transthyretin-Type Amyloidoses by Sulfite", Neurogenetics, 2: 183-188, 1999.
Azriel et al. "Analysis of the Minimal Amyloid-Forming Fragment of the Islet Amyloid Polypeptide", The Journal of Biological Chemistry, 276(36): 34156-34161, 2001.
Kimura et al. "Analysis and Prediction of Absorption Profile Including Hepatic First-Pass Metabolism of N-Methyltyramine, A Potent Stimulant of Gastrin Release Present in Beer, After Oral Ingestion in Rats by Gastrointestinal-Transit-Absorption Model", Drug Metabolism and Disposition, 28(5): 577-581, 2000.
Higaki et al. "Regulation of Drug Absorption From Small Intestine by Enteric Nervous System 1: A Poorly Absorbable Drug Via Passive Diffusion", Drug Metabolism and Pharmacokinetics, 19(3): 198-205, 2004.
Kisilevsky et al. "Arresting Amyloidosis In Vivo Using Small-Molecule Anionic Sulphonates or Sulphates: Implications for Alzheimer's Disease", Nature Medicine, 1: 143-148, 1995. Abstract.
Kocisko et al. "New Inhibitors of Scrabie-Associated Prion Protein Formation in a Library of 2,000 Drugs and Natural Products", Journal of Virology, 77(19): 10288-10294, 2003.
Lashuel et al. "New Class of Inhibitors of Amyloid-? Fibril Formation Implications for the Mechanism of Pathogenesis in Alzheimer's Disease", The Journal of Biological Chemistry, 277(45): 42881-42890, 2002.
Oza et al. "Synthesis and Evaluation of Anthranilic Acid-Based Transthyretin Amyloid Fibril Inhibitors", Bioorganic & Medicinal Chemistry Letters, 9: 1-6, 1999.
Peterson et al. "Inhibiting Transthyretin Conformational Chamges That Lead to Amyloid Fibril Formation", Proc. Natl. Acad. Sci. USA, 95: 12956-12960, 1998.
Westwater et al. "Use of Genetically Engineered Phage to Deliver Antimicrobial Agents to Bacteria: An Alternative Therapy for Treatment of Bacterial Infections", Antimicrobial Agents and Chemotherapy, 47 (4): 1301-1307, 2003.
Lazaris et al. "Spider Silk Fibers Spun From Soluble Recombinant Silk Produced in Mammalian Cells", Science, 295: 472-476, 2002. p. 474-475.
Gazit "Mechanisms of Amyloid Fibril Self-Assembly and Inhibition Model Short Peptides as A Key Research Tool", The FEBS Journal, 272: 5971-5978, 2005.
Jack et al. "The Organization of Aromatic Side Groups in an Amyloid Fibril Probed by Solid-State 2H and 19F NMR Spectroscopy", Journal of the American Chemical Society, JACS, 128: 8098-8099, 2006.
Reches et al. "Designed Aromatic Homo-Dipeptides: Formation of Ordered Nanostructures and Potential Nanotechnological Applications", Physical Biology, 3: S10-S19, 2006.
Mahler et al. "Rigid, Self-Assembled Hydrogel Composed of A Modified Aromatic Dipeptide", Advanced Materials, 18(11): 1365-1370, 2006.
Bong et al. "Self-Assembling Organic Nanotubes", Angewandte Chemie, International Edition,40:988-1011, 2001.
Vauthey et al. "Molecular Self-assembly of Surfactant-Like Peptides to form Nanotubes and Nanovesicles", PNAS,99(8):5355-5360, 2002.
Ghardiri et al. "Artificial Transmembrane Ion Channels from Self-Assembling Peptide Nanotubes", Nature,369(6478):301-304, 1994.
Huang et al. "A Review on Polymer Nanofibers by Electrospinning and Their Applications in Nanocomposites", Composites Science and Technology, 63: 2223-2253, 2003.
Kaplan "Fibrous Proteins-Silk as a Model System", Polymer Degradation and Stability, 59: 25-32, 1998.
Kubik "High-Performance Fibers from Spider Silk", Angewandte Chemie, International Edition, 41(15): 2721-2723, 2002.
Jin "Electrospinning Bombyx Mori Silk With Poly (Ethylene Oxide)" Biomacromolecules, 3: 1233-1239, 2002.
Tsang et al. "A Simple Chemical Method of Opening and Filling Carbon Nanotubes", Nature, 372: 159-162, 1994.
Goerbitz "Nanotube Formation by Hydrophobic Dipeptides", Chemical European Journal, 7(23): 5153-5159, 2001.
Gazit "A Possible Role for 'Phi'-Stacking in the Self-Assembly of Amyloid Fibrils", The FASEB Journal, 16: 77-83, 2002.
Soto et al. Beta-Sheet Breaker Peptides Inhibit Fibrillogenesis in A Rat Brain Model of Amyloidosis: Implications for Alzheimer's Therapy, Nature Medicine, 4(7): 822-826, 1998.
Grady et al. "Axe-Txe, A Broad-Spectrum Proteic Toxin-Antitoxin System Specified by A Multidrug-Resistant, Clinical Isolate of Enterococcus Faeciurn", Molecular Biology, 47(5): 1419-1432, 2003. Abstract, p. 1424, col. 1-p. 1426, col. 2, Fig.5.
Cherny et al. "The YefM Antitoxin Defines A Family of Natively Unfolded Proteins", The Journal of Biological Chemistry, 279(9): 8252-8261, 2004.
Engelberg-Kulka et al. "Bacterial Programmed Cell Death Systems as Targets for Antibiotics", Trends in Microbiology, 12(2): 66-71, 2004.
Inglot "Comparison of the Antiviral Activity In Vitro of Some Non-Steroidal Anti-Inflammatory Drugs", Journal of General Virology, 4(2): 203-214, 1969.
Pavia et al. "Antimicrobial Activity of Nicotine Against a Spectrum of Bacterial and Fungal Pathogens", Journal of Medical Microbiology, 49(7): 675-676, 2000.
Grady et al. "Axe-Txe, A Broad-Spectrum Proteic Toxin—Antitoxin System Specified by a Multidrug-Resistant, Clinical Isolate of Enterococcus Faecium", Molecular Microbiology, vol. 47(5: p. 1419-1432, 2003.
Harrison et al. "Amyloid Peptides and Proteins in Review", Reviews in Physiology, Biochemistry and Pharmacology, 159: 1-77, 2007.
Akazome et al. "Enantioselective Inclusion of Methyl Phenyl Sulfoxides and Benzyl Methyl Sulfoxides by (R)-Phenylglycyl-(R)-Phenylglycine and the Crystal Structures of the Inclusion Cavities", Journal of Organic Chemistry, 65(1): 68-76, 2000.
Anguiano et al. "Protofibrillar Islet Amyloid Polypeptide Permeabilizes Synthetic Vesicles by A Pore-Like Mechnaism That May Be Relevant to Type II Diabetes", Biochemistry, 41: 11338-11343, 2002.
Arvinte et al. "The Structure and Mechanism of Formation of Human Calcitonin Fibrils", The Journal of Biological Chemistry, 268(9): 6415-6422, 1993.
Austin et al. "Medical Progress: Calcitonin. Physiology and Pathophysiology", The New England Journal of Medicine, 304(5): 269-278, 1981.
Balaram "De Novo Design: Backbone Conformational Constraints in Nucleating Helices and β-Hairpins", Journal of Peptide Research, 54: 195-199, 1999.
Balbach et al. "Supramolecular Structure in Full-Length Alzheimer's β-Amyloid Fibrils: Evidence for A Parallel β-Sheet Organization From Solid-State Nuclear Magnetic Resonance", Biophysical Journal, 83: 1205-1216, 2002.
Bauer et al. "Interfacial Adsorption and Aggregation Associated Changes in Secondary Structure of Human Calcitonin Monitored by ATR-FTIR Spectroscopy", Biochemistry, 33: 12276-12282, 1994.
Benvenga et al. "Homology of Calcitonin With the Amyloid-Related Proteins", Journal of Endocrinological Investigation, 17: 119-122, 1994.
Berger et al. "Calcitonin-Like Immunoreactivity of Amyloid Fibrils in Medullary Thyroid Carcinomas", Virchows Archiv A Pathological Anatomy and Histopathology, 412: 543-551, 1988.
Berson et al. "Proprotein Convertase Cleavage Liberates A Fibrillogenic Fragment of A Resident Glycoprotein to Initiate Melanosome Biogenesis", Journal of Cell Biology, 161(3): 521-533, 2003.
Bird et al. "Single-Chain Antigen-Binding Proteins", Science, 242(4877): 423-426, 1988.
Boerner et al. "Production of Antigen-Specific Human Monoclonal Antibodies From In Vitro-Primed Human Splenocytes", The Journal of Immunology, 147(1): 86-95, 1991.
Chapman et al. "Role of *Escherichia coli* Curti Operons in Directing Amyloid Fiber Formation", Science, 295(5556): 851-855, 2002, Abstract.
Cherny et al. "The Formation of *Escherichia coli* Curli Amyloid Fibrils is Mediated by Prion-Like Peptide Repeats", Journal of Molecular Biology, 352(2): 245-252, 2005.

Choplin "Computers and the Medicinal Chemist", Comprehensive Medicinal Chemistry, 4(Chap.17.2): 33-58, 1990.
Chou et al. "Conformational Parameters for Amino Acids in Helical, β-Sheet, and Random Coil Regions Calculated From Proteins", Biochemistry, 13(2): 211-222, 1974.
Chou et al. "Empirical Predictions of Protein Conformation", Annual Reviews in Biochemistry, 47: 251-276, 1978.
Claessen et al. "A Novel Class of Secreted Hydrophodic Proteins is Involved in Aerial Hyphae Formation in Streptomyces Coelicolor by Forming Amyloid-Like Fibrils", Genes & Development, 17: 1714-1726, 2003.
Claessens et al. "Review Commentary: π-πInteractions in Self-Assembly", Journal of Physical Organic Chemistry, 10: 254-272, 1997.
Clark et al. "Self-Assembling Cyclic β3-Peptide Nanotubes as Artificial Transmembrane Ion Channels", Journal of the American Chemical Society, JACS, 120: 651-656, 1998.
Cole et al. "The EBV-Hybridoma Technique and Its Application to Human Lung Cancer", Monoclonal Antibodies and Cancer Therapy, Proceedings of the Roche-UCLA Symposium, Park City, Utah, p. 77-96, 1985.
Copp "Endocrine Regulation of Calcium Metabolism", Annual Reviews in Physiology, 32: 61-86, 1970.
Elliot et al. "The Chaplins: A Family of Hydrophobic Cell-Surface Proteins Involved in Aerial Mycelium Formation in Streptomyces Coelicolor", Genes & Development, 17: 1727-1740, 2003.
Findeis et al. "Modified-Peptide Inhibitors of Amyloid β-Peptide Polymerization", Biochemistry, 38: 6791-6800, 1999.
Fingl et al. "Inroduction: General Principles", The Pharmacological Basis of Therapeutics, 5th Ed., Sec.I(Chap. 1): 1-53, 1975.
Fishwild et al. "High-Avidity Hum IgGκ Monoclonal Antibodies From A Novel Strain of Minilocus Transgenic Mice", Nature Biotechnology, 14: 845-851, 1996.
Forloni et al. "Anti-Amyloidogenic Activity of Tetracyclines: Studies in Vitro", FEBS Letters, 487(3): 404-407, 2001. Figs. 1,3.
Gazit "Mechanistic Studies of Process of Amyolid Fibrils Formation by the Use of Peptide Fragments and Analogues: Implications for the Design of Fibrillization Inhibitors", Current Medicinal Chemistry, 9: 1725-1735, 2002.
Gillard et al. "Controlling Self-Assembly", Chemical European Journal, 3(12): 1933-1940, 1997.
Görbitz "Nanotube Formation by Hydrophobic Dipeptides", Chemistry, 7(23): 5153-5159, 2001, Abstract.
Grateau "[Coli's Curli or How Amyloid Can be Physiological.]", Médecine Sciences, 18(6-7): p. 664, 2002.
Häggqvist et al. "Medin: An Integral Fragment of Aortic Smooth Muscle Cell-Produced Lactadherin Forms the Most Common Human Amyloid", Proc. Natl. Acad. Sci. USA, 96: 8669-8674, 1999.
Haldar et al. "First Crystallographic Signature of the Highly Ordered Supramolecular Helical Assemblage from a Tripeptide Containing a Non-Coded Amino Acid", Tetrahedron Letters, 43(14): 2653-2656, 2002, Abstract.
Harlow et al. "Antibodies: A Laboratory Manual", Cold Spring Harbor Laboratory, p. III-IX, 1988.
Hartgerink et al. "Peptide Nanotubes and Beyond", Chemistry European Journal, 4(8): 1367-1372, 1998, Abstract.
Holmes et al. "Extensive Neurite Outgrowth and Active Synapse Formation on Self-Assembling Peptide Scaffolds", Proc. Natl. Acad. Sci. USA, 97(12): 6728-6733, 2000.
Hoogenboom et al. "By-Passing Immunisation. Human Antibodies From Synthetic Repertoires of Germline $V_H$ Gene Segments Rearranged In Vitro", Journal of Molecular Biology, 227: 381-388, 1992.
Hoyle et al. "Pseudomonas Aeruginosa Biofilm as A Diffusion Barrier to Piperacillin", Antimicrobial Agents and Chemotherapy, 36(9): 2054-2056, 1992.
Inbar et al. "Localization of Antibody-Combining Sites Within the Variable Portions of Heavy and Light Chains", Proc. Natl. Acad. Sci. USA, 69(9): 2659-2662, 1972.
Jayawarna et al. "Nanostructured Hydrogels for Three-Dimensional Cell Culture Through Self-Assembly of Fluorenylmethoxycarbonyl-Dipeptides", Advanced Materials, 18: 611-614, 2006.
Jones et al. "Replacing the Complementarity-Determining Regions in A Human Antibody With Those From A Mouse", Nature, 321: 522-525, 1986.
Kamihira et al. "Conformational Transitions and Fibrillation Mechanism of Human Calcitonin as Studied by High-Resolution Solid-State 13C NMR [in Process Citation]", Protein Science, 9: 867-877, 2000.
Kanaori et al. "Study of human Calcitonin Fibrillation by Proton Nuclear Magnetic Resonance Spectroscopy", Biochemistry, 34: 12138-12143, 1995.
Kapurniotu et al. "Structure-Based Design and Study of Non-Amyloidogenic, Double N-Methylated IAPP Amyloid Core Sequences as Inhibitors of IAPP Amyloid Formation and Cytotoxicity", Journal of Molecular Biology, 315: 339-350, 2002.
Kedar et al. "In Vitro Synthesis of 'Amyloid' Fibrils From Insulin, Calcitonin and Parathormone", Israel Journal of Medical Science, 12(10): 1137-1140, 1976.
Kyte et al. "A Simple Method for Displaying the Hydropathic Character of A Protein", Journal of Molecular Biology, 157: 105-132, 1982.
Lansbury "Following Nature's Anti-Amyloid Strategy", Nature Biotechnology, 19(2): 112-113, 2001. p. 112, Left-Hand Col., Paragraph 1-Middle Col., Paragraph 1.
Larrick et al. "PCR Amplification of Antibody Genes", Methods: A Companion to Methods in Enzymology, 2(2): 106-110, 1991.
Lonberg et al. "Antigen-Specific Human Antibodies From Mice Comprising Four Distinct Genetic Modifications", Nature, 368(6474): 856-859, 1994.
Lonberg et al. "Human Antibodies From Transgenic Mice", International Review of Immunology, 13: 65-93, 1995.
Lowe et al. "Structure-Function Relationships for Inhibitors of β-Amyloid Toxicity Containing the Recognition Sequence KLVFF", Biochemistry, 40: 7882-7889, 2001.
Lyon et al. "Self-Assembly and Gelation of Oxidized Gluthathione in Organic Solvents", Journal of the American Chemical Society, 123: 4408-4413, 2001.
Mah et al. "A Genetic Basis for Pseudomonas Aeruginosa Biofilm Antibiotic Resistance", Nature, 426: 306-310, 2003.
Maji et al. "Fibril-Forming Model Synthetic Peptides Containing 3-Aminophenylacetic Acid", Tetrahedron, 58(43): 8695-8702, 2002, Abstract.
Marks et al. "By-Passing Immunization—Human Antibodies from V-Gene Libraries Displayed on Phage", Journal of Molecular Biology, 222: 581-597, 1991.
Marks et al. "By-Passing Immunization: Building High Affinity Human Antibodies by Chain Shuffling", Bio/Technology, 10: 779-783, 1992.
Maury et al. "Creation of Amyloid Fibrils From Mutant ASN187 Gelsolin Peptides", Biochemical and Biophysical Research Communications, 183(1): 227-231, 1992.
McGaughey et al. "n-Stacking Interactions", The Journal of Biological Chemistry, 273(25): 15458-15463, 1998.
Meluleni et al. "Mucoid Pseudomonas Aeruginosa Growing in A Biofilm in Vitro are Killed by Opsonic Antibodies to the mucoid Exopolysaccharide Capsule but Not by Antibodies Produced During Chronic Lung Infection in Cystic Fibrosis Patients[1],[2]", Journal of Immunology , 155:2029-2038, 1995.
Morrison "Success in Specification", Nature, 368(6474): 812-813, 1994.
Mosmann "Rapid Colorimetric Assay for Cellular Growth and Survival: Application to Proliferation and Cytotoxicity Assays", Journal of Immunological Methods, 65: 55-63, 1983.
Mosselman et al. "The Complete Islet Amyloid Polypeptide Precursor Is Encoded by Two Exons", FEBS Letters, 247: 154-158, 1989, Database Accession No. S04016.
Murphy et al. "Biofilm Formation by Nontypeable Haemophilus Influenzae: Strain variability, Outer Membrane Antigen Expression and Role of pili", BMC Microbiology, 2(7): 1471-2180, 2002.
Mutter "Studies on the Coupling Rates in Liquid-Phase Peptide Synthesis Using Competition Experiments", International Journal of Peptide Protein Research, 13: 274-277, 1979.
Neuberger "Generating High-Avidity Human Mabs in Mice", Nature Biotechnology, 14: 826, 1996.
Nicolaus "Symbiotic Approach to Drug Design", Decision Making in Drug Research, p. 173-186, 1983.

Offen et al. "A Low Molecular Weight Copper Chelator Crosses the Blood-Brain Barrier and Attenuates Experimental Autoimmune Encephalomyelitis", Journal of Neurochemistry, 89: 1241-1251, 2004.
Pack et al. "Improved Bivalent Miniantibodies, With Identical Avidity as Whole Anitbodies, Produced by High Cell Density Fermentation of *Escherichia coli*", Bio/Technology, 11: 1271-1277, 1993.
Petkova et al. "A Structural Model for Alzheimer's β-Amyloid Fibrils Based on Experimental Constraints From Solid State NMR", Proc. Natl. Acad. Sci. USA, 99(26): 16742-16747, 2002.
Pettmann et al. "Morphological and Biochemical Maturation of Neurones Cultured in the Absence of Glial Cells", Nature, 281: 378-380, 1979.
Pispisa et al. "A Spectroscopic and Molecular Mechanics Investigation on A Series of AIB-Based Linear Peptides and A Peptide Template, Both Containing Tryptophan and A Nitroxide Derivative as Probes", Biopolymers, 53: 169-181, 2000.
Porter "The Hydrolysis of Rabbit γ-Globulin and Antibodies With Crystalline Papain", Biochemical Journal, 73: 119-126, 1959.
Presta "Antibody Engineering", Current Opinion in Structural Biology, 2: 593-596, 1992.
Puchtler et al. "A Review of Early Concepts of Amyloid in Context With Contemporary Chemical Literature From 1839 to 1859", The Journal of Histochemistry and Cytochemistry, 14(2): 123-134, 1966.
Reches et al. "Amyloid Fibril Formation by Pentapeptide and Tetrapeptide Fragments of Human Calcitonin", The Journal of Biological Chemistry, 277(38): 35475-35480, 2002.
Reches et al. "Casting Metal Nanowires Within Discrete Self-Assembled Peptide Nanotubes", Science, 300(5619): 625-627, 2003, Abstract.
Reches et al. "Self-Assembly of Peptide Nanotubes and Amylois-Like Structures by Charged-Termini-Capped Diphenylalanine Peptide Analogues", Israel Journal of Chemistry, 45(3): 363-371, 2005.
Reches et al. "Supporting Online Material", Science, 300(5619): 1-9, 2003. Retrieved From the Internet: URL:http://www.sciencemag.org/cgi/data/300/5619/625/DC1.
Riechmann et al. "Reshaping Human Antibodies for Therapy", Nature, 332: 323-329, 1988.
Sacchettini et al. "Therapeutic Strategies for Human Amyloid Diseases", Nature Reviews: Drug Discovery, 1: 267-275, 2002.
Shetty et al. "Aromatic π-Stacking in Solution as Revealed Through the Aggregation of Phenylacetylene Macrocycles", Journal of the American Chemical Society, 118: 1019-1027, 1996.
Sigel-Causey et al. "Phylogeny of the Pelecaniformes: Molecular Systematics of A Privative Group", Avian Molecular Evolution and Systematics, academic Press, p. 159-171, NBCI GenBank, Accession No. AAB58518, 1997.
Solomon et al. "Disaggregation of Alzheimer β-Amyloid by Site-Directed MAb", Proc. Natl. Acad. Sci. USA, 94: 4109-4112, 1997.
Stewart "Theoretical Aspects of Antibiotic Diffusion Into Microbial Biofilms", Antimicrobial Agents and Chemotherapy, 40(11): 2517-2522, 1996.
Sun et al. "Aromatic Van der Waals Clusters: Structure and Nonrigidity", Journal of Physical Chemistry, 100: 13348-13366, 1996.
Tjernberg et al. "Arrest of β-Amyloid Fibril Formation by A Pentapeptide Ligand", The Journal of Biological Chemistry, 271(15): 8545-8548, 1996.
Tjernberg et al. "Controlling Amyloid β-Peptide Fibril Formation With Protease-Stable Ligands", The Journal of Biological Chemistry, 272(19): 12601-12605, 1997.
Toledano et al. "Enzyme-Triggered Self-Assembly of Peptide Hydrogels Via Reversed Hydrolysis", Journal of the American Chemical Society, JACS, 128(4): 1070-1071, 2006.
Tonkinson et al. "Antisense Oligodeoxynucleotides as Clinical Therapeutic Agents", Cancer Investigation, 14(1): 54-65, 1996.
True et al. "Epigenetic Regulation of Trenslation Reveals Hidden Genetic Variation to Produce Complex Traits", Nature, 431: 184-187, 2004.
Tsai et al. "Synthesis of AIB-Containing Peptidomimetics as Potential Inhibitors of Alzheimer's γ-Secretase", 218th ACS National Meeting, New Orleans, USA, Meeting Abstract, MEDI-018, 1999. Abstract.
Tuite et al. "Propagation of Yeast Prions", Nature Reviews, 4: 878-889, 2003.
Verhoeyen et al. "Reshaping Human Antibodies: Grafting An Antilysozyme Activity", Science, 239: 1534-1536, 1988.
Vidal et al. "A Stop-Codon Mutation int he BRI Gene Associated With Familial British Dementia", Nature, 399: 776-781, 1999.
Whitlow et al. "Single-Chain Fv Proteins and Their Fusion Proteins", Methods: A Companion to Methods in Enzymology, 2(2): 97-105, 1991.
Wolfenden et al. "Affinities of Amino Acid Side Chains for Solvent Water", Biochemistry, 20: 849-855, 1981.
Yokoi et al. "Dynamic Reassembly of Peptide RADA16 Nanofiber Scaffold", Proc. Natl. Acad. Sci. USA, 102(24): 8414-8419, 2005.
Zaidi et al. "Forty Years of Calcitonin—Where Are We Now? A Tribute to the Work of lain Macintyre, FRS", Bone, 30(5): 655-663, 2002.
Zhang et al. "Supramolecular Hydrogels Respond to Ligand-Receptor Interaction", Journal of the American Chemical Society, 125(45): 13680-13681, 2003.
Notice of Allowance Dated Mar. 26, 2010 From the US Patent and Trademark Office Re.: U.S. Appl. No. 11/662,136.
Response Dated Apr. 12, 2010 to Official Action of Dec. 11, 2009 From the US Patent and Trademark Office Re.: U.S. Appl. No. 12/318,653.
Notice of Allowability Dated May 21, 2010 From the US Patent and Trademark Office Re.: U.S. Appl. No. 11/662,136.
Official Action Dated Jul. 22, 2010 From the US Patent and Trademark Office Re.: U.S. Appl. No. 12/318,653.
Communication Pursuant to Article 94(3) EPC Dated Jun. 8, 2010 From the European Patent Office Re.: Application No. 06796163.1.
Office Action Dated Jun. 17, 2010 From the Israel Patent Office Re.: Application No. 169120 and Its Translation Into English.
Official Action Dated Jun. 9, 2010 From the US Patent and Trademark Office Re.: U.S. Appl. No. 11/662,136.
Official Action Dated Jun. 30, 2010 From the US Patent and Trademark Office Re.: U.S. Appl. No. 11/662,136.
Communciation Pursuant to Article 96(2) EPC Dated Mar. 30, 2006 From the European Patent Office Re.: Application No. 04700494.0.
Communication Pursuant to Article 94(3) EPC Dated Sep. 4, 2008 From the European Patent Office Re.: Application No. 03777149.0.
Communication Pursuant to Article 94(3) EPC Dated Sep. 15, 2009 From the European Patent Office Re.: Application No. 09002048.8.
Communication Pursuant to Article 94(3) EPC Dated Dec. 29, 2009 From the European Patent Office Re.: Application No. 03777149.0.
Communication Pursuant to Article 96(2) EPC Dated May 14, 2007 From the European Patent Office Re.: Application No. 03777149.0.
Communication Pursuant to Article 96(2) EPC Dated Jan. 14, 2007 From the European Patent Office Re.: Application No. 04700494.0.
Communication Under Rule 112 EPC Dated Mar. 31, 2006 From the European Patent Office Re.: Application No. 03777149.0.
Communication Under Rule 71(3) EPC Dated Oct. 7, 2008 From the European Patent Office Re.: Application No. 04700494.0.
Examination Report Dated May 10, 2007 From the Government of India, Patent Office Re.: Application No. 1499/CHENP/2005.
Examination Report Dated Jun. 19, 2006 From the Intellectual Property Office of India Re.: Application No. 1510/CHENP/2005.
International Search Report and the Written Opinion Dated Jul. 15, 2008 From the International Searching Authority Re.: Application No. PCT/IL05/00954.
International Search Report and the Written Opinion Dated Aug. 22, 2007 From the International Searching Authority Re.: Applicaiton No. PCT/IL2006/001174.
Notice of Allowance Dated Sep. 17, 2008 From the US Patent and Trademark Office Re.: U.S. Appl. No. 11/148,266.
Notice of Allowance Dated Jun. 18, 2008 From the US Patent and Trademark Office Re.: U.S. Appl. No. 11/148,262.
Office Action Dated Aug. 4, 2009 From the Israel Patent Office Re.: Application No. 169120 and Its Translation Into English.
Office Action Dated Jul. 14, 2009 From the Israel Patent Office Re.: Application No. 169121 and Its Translation Into English.
Office Action Dated Mar. 28, 2007 From the Israel Patent Office Re.: Application No. 169120.

Official Action Dated Dec. 11, 2009 From the US Patent and Trademark Office Re.: U.S. Appl. No. 12/318,653.
Official Action Dated Feb. 15, 2008 From the US Patent and Trademark Office Re.: U.S. Appl. No. 11/148,262.
Official Action Dated Jun. 22, 2009 From the US Patent and Trademark Office Re.: U.S. Appl. No. 12/318,653.
Official Action Dated Apr. 30, 2007 From the US Patent and Trademark Office Re.: U.S. Appl. No. 11/148,262.
Response Dated Jul. 9, 2008 to Notice of Allowance of Jun. 18, 2008 From the US Patent and Trademark Office Re.: U.S. Appl. No. 11/148,262.
Response Dated Mar. 9, 2009 to Communication Pursuant to Article 94(3) EPC of Sep. 4, 2008 From the European Patent Office Re.: Application No. 03777149.0.
Response Dated Jan. 12, 2010 to Communication Pursuant to Article 94(3) EPC of Sep. 15, 2009 From the European Patent Office Re.: Application No. 09002048.8.
Response Dated Dec. 13, 2007 to Communication Pursuant to Article 96(2) EPC of Jul. 17, 2006 From the European Patent Office Re.: Application No. 03777149.0.
Response Dated May 22, 2007 to Communication Pursuant to Article 96(2) EPC of Jan. 18, 2007 From the European Patent Office Re.: Application No. 04700494.0.
Second Notice of Allowance Dated Sep. 16, 2008 From the US Patent and Trademark Office Re.: U.S. Appl. No. 11/148,262.
Supplementary European Search Report Dated Jun. 10, 2009 From the European Patent Office Re.: Application No. 05747261.5.
Response Dated Apr. 22, 2010 to Communication Pursuant to Article 94(3) EPC of Dec. 29, 2009 From the European Patent Office Re.: Application No. 03777149.0.
Ajayan et al. "Application of Carbon Nanotubes", Topics of Applied Physics, 80: 391-425, 2001.
Chapman et al. "Role of *Escherichia coli* Curli Operons in Directing Amyloid Fiber Formation", Science, 295(5556): 851-855, 2002. Abstract.
Hayden et al. "'A' Is for Amylin and Amyloid in Type 2 Diabetes Mellitus", JOP Journal of the Pancreas (Online), 2(4): 124-139, 2001.
Li et al. "Amyloid-Like Formation by Self-Assembly of Peptidolipids in Two Dimensions", Langmuir: The ACS Journal of Surfaces and Colloids, XP002529300, 20(20): 8641-8645, Aug. 25-Sep. 28, 2004.
Liao et al. "Triphenylmethane Dyes as Inhibitors of Reverse Transcriptase RNA Polymerase and Protein Synthesis: Structure Activity Relationships", Journal of Medicinal Chemistry, 18(1): 117-120, 1975. Abstract.
MacPhee et al. "Engineered and Designed Peptide-Based Fibrous Biomaterials", Current Opinion in Solid State and Materials Science, XP002529298, 8(2): 141-149, Mar. 2004.
Martin et al. "The Emerging Field of Nanotube Biotechnology", Nature Reviews: Drug Discovery, 2(1): 29-37, Jan. 2003. Abstract.
Reches et al. "Self-Assembly of Peptide Nanotubes and Amyloid-Like Structures by Charged-Termini-Capped Diphenylalanine Peptide Analogues", Israel Journal of Chemistry, XP009087914, 45(3): 363-371, Jun. 30, 2005.
Ryadnov et al. "Engineering the Morphology of a Self-Assembling Protein Fibre", Nature Materials, XP002529299, 2(5): 329-332, May 2003.
Stephenson et al. "The 'Promiscuous Drug Concept' With Applications to Alzheimer's Disease", FEBS Letters, 579: 1338-1342, 2005.
Zhang et al. "Design of Nanostructured Biological Materials Through Self-Assembly of Peptides and Proteins", Current Opinion in Chemical Biology, 6: 865-871, 2002.
Office Action Dated May 30, 2010 From the Israel Patent Office Re.: Application No. 169121 and Its Translation Into English.
Official Action Dated Aug. 30, 2010 From the US Patent and Trademark Office Re.: U.S. Appl. No. 12/318,619.

* cited by examiner

Figure 5a
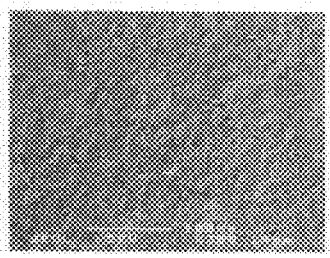
Figure 5b
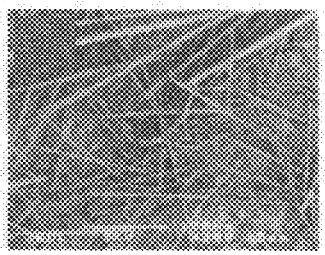
Figure 5c
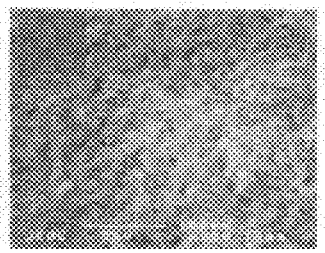
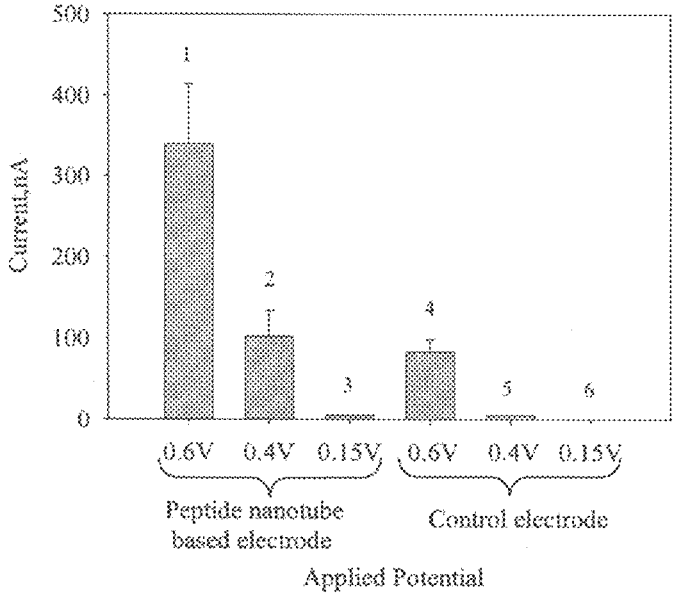
Figure 6

PEPTIDE NANOSTRUCTURE-COATED ELECTRODES

RELATED APPLICATION

This application claims the benefit of U.S. Provisional Patent Application No. 60/732,641 filed on Nov. 3, 2005, the contents of which are hereby incorporated in its entirety.

FIELD AND BACKGROUND OF THE INVENTION

The present invention relates to novel, highly sensitive electrodes and to methods of generating and using same in detection of a variety of molecules.

During the last few years much interest has been focused on the development of analytical methods allowing rapid "on-the-spot" performances for medical diagnostics and to measure environmental pollutants. A device operating in remote sites, such as an ambulance, an agricultural farm, or in field testing of environmental pollutants, should provide fast, sensitive, small and inexpensive measurements. Moreover, for measurements held in the field, the device should be simple to operate by a non-qualified person.

In amperometric measurements a potential is applied between a working electrode and a reference electrode and the resulting current is measured. Often a third electrode, an auxiliary electrode, is used for current collection.

The response of a working electrode depends on the chemical (electrochemical) reaction variables. These include the electrode surface where the reaction takes place, the mobile phase (reaction medium), and the compound undergoing the reaction.

Measurements are performed either at constant or varying potential between the working electrode and the reference electrode. In cyclic voltammetry the potential is changed linearly from an initial potential to a final potential and then back to the initial value, and the resulting current is measured. When an electroactive molecule is present in the tested solution, a peak is observed. The scan rate (rate of potential changed) affect the peak height and the peak position depends on kinetic constants of the electrochemical reaction.

A number of diagnostic tests are routinely performed on humans to evaluate the amount or existence of substances present in blood or other bodily fluids. These diagnostic tests typically rely on physiological fluid samples removed from a subject, either using a syringe or by pricking the skin.

Biological samples can be tested for the presence of a specific molecule by using a detector electrode capable of electrochemically reacting with the detected molecule.

Amperometric biosensors combine the specificity and selectivity of biological interaction reactions with the analytical power of electrochemistry. Many analytes are not intrinsically electroactive and cannot be detected directly. The use of enzymes that catalyze biospecific reactions facilitates the production of electroactive species which then can be determined electrochemically.

Since their discovery in 1991, carbon nanotubes (CNTs) have been extensively studied both theoretically and experimentally due to their unique physical and chemical properties. Such nano-scale tubular structures have been suggested as potential functional elements in nanotechnological devices and applications.

Kong et al. (2000) was the first to build a CNT based chemical sensor for detection of $NH_2$ and $NH_3$ gas. Chen et al. (2001) immobilized proteins on CNTs through a linking molecule and Besteman et al. (2003), Lin et al. (2004) and Wang et al. (2003) demonstrated the use of CNTs as biological sensors for detection of glucose. The unique electric properties together with significant surface enlargement made CNTs an important component in sensing applications.

Studies also showed that bioorganic molecules can also self-assemble into well-ordered structures at the nanometric level (Hartgerink et al. 2001; Ashkenasy et al., 2006). Biomolecular nanostructures are an especially intriguing group of supramolecular assemblies because they facilitate a wide range of chemical modifications. Moreover, such nanostructures enable exploitation of the specificity of biological systems for biosensing, catalytic activity, and highly specific molecular recognition processes.

Well-ordered and discrete peptide nanotubes that are self assembled from aromatic peptides (e.g., diphenylalanine peptides) and uses thereof in numerous mechanical, electrical, chemical, optical and biotechnological systems have recently been reported (see, for example, Reches and Gazit 2003, 2004; WO 2004/052773; WO 2004/060791; PCT/IL2005/000589; WO 2006/027780 and U.S. patent application Ser. Nos. 11/148,262 and 11/148,266, which are all incorporated by reference as if fully set forth herein).

These peptide nanotubes are biocompatible and water soluble. They show notable similarity to carbon nanotubes in their morphology and aspect ratio. Their assembly as individual entities rather then bundles, makes them appealing for various nanotechnological applications.

It has thus been envisioned that electrodes coated with peptide nanostructures could exhibit the desired characteristics required for efficient and sensitive electrochemical measurements.

SUMMARY OF THE INVENTION

While reducing the present invention to practice, the present inventors have demonstrated that electrodes coated with peptide nanostructures exhibit enhanced electrochemical sensitivity and thus are highly suitable for use in electrochemical detection of various molecules and particularly as sensitive biosensors in biomolecular diagnostics.

According to one aspect of the present invention there is provided an electrode comprising a plurality of peptide nanostructures, the peptide nanostructures being composed of a plurality of peptides self-assembled into the peptide nano structures, the electrode being capable of conducting a response current resulting from an electrochemical reaction in a proximity thereof.

According to further features in preferred embodiments of the invention described below, the electrode further comprising a support having a surface, the peptide nanostructures being attached to the surface.

According to still further features in the described preferred embodiments the support comprises a material selected from the group consisting of silicon oxide, carbon, graphite, nickel, gold, silver, platinum and copper.

According to still further features in the described preferred embodiments each of the peptides in the plurality of peptides comprises from 2 to 15 amino acid residues According to still further features in the described preferred embodiments each of the peptides in the plurality of peptides comprises from 2 to 7 amino acid residues.

According to still further features in the described preferred embodiments each of the peptides in the plurality of peptides comprises at least one aromatic amino acid residue.

According to still further features in the described preferred embodiments at least one peptide in the plurality of peptides is an end-capping modified peptide.

According to still further features in the described preferred embodiments at least one peptide in the plurality of peptides consists essentially of aromatic amino acid residues.

According to still further features in the described preferred embodiments the aromatic amino acid residue comprises an aromatic moiety selected from the group consisting of substituted or unsubstituted naphthalenyl, substituted or unsubstituted phenanthrenyl, substituted or unsubstituted anthracenyl, substituted or unsubstituted [1,10]phenanthrolinyl, substituted or unsubstituted [2,2']bipyridinyl, substituted or unsubstituted biphenyl and substituted or unsubstituted phenyl.

According to still further features in the described preferred embodiments at least one peptide in the plurality of peptides is a dipeptide.

According to still further features in the described preferred embodiments at least one of the dipeptides is a homodipeptide.

According to still further features in the described preferred embodiments the homodipeptide is selected from the group consisting of naphthylalanine-naphthylalanine dipeptide, phenanthrenylalanine-phenanthrenylalanine dipeptide, anthracenylalanine-anthracenylalanine dipeptide, [1,10] phenanthrolinylalanine-[1,10]phenanthrolinylalanine dipeptide, [2,2']bipyridinylalanine-[2,2']bipyridinylalanine dipeptide, (pentahalo-phenylalanine)-(pentahalo-phenylalanine) dipeptide, phenylalanine-phenylalanine dipeptide, (amino-phenylalanine)-(amino-phenylalanine) dipeptide, (dialkylamino-phenylalanine)-(dialkylamino-phenylalanine) dipeptide, (halophenylalanine)-(halophenylalanine) dipeptide, (alkoxy-phenylalanine)-(alkoxy-phenylalanine) dipeptide, (trihalomethyl-phenylalanine)-(trihalomethyl-phenylalanine) dipeptide, (4-phenyl-phenylalanine)-(4-phenyl-phenylalanine) dipeptide and (nitro-phenylalanine)-(nitro-phenylalanine) dipeptide.

According to still further features in the described preferred embodiments each peptide in the plurality of peptides is a phenylalanine-phenylalanine dipeptide.

According to still further features in the described preferred embodiments each of the peptide nanostructures is attached to the surface via interactions selected from the group consisting of hydrogen bond interactions, hydrophobic interactions, covalent interactions, coordinative interactions, electrostatic interactions and surface interactions.

According to still further features in the described preferred embodiments at least one peptide in the plurality of peptides forming the peptide nanostructures comprises a functional group for forming the interactions with the surface.

According to still further features in the described preferred embodiments the electrode further comprising a moiety being capable of generating an electrochemically reactive molecule and/or capable of reacting with and/or capturing a molecule generating an electrochemically reactive molecule upon the electrochemical reaction.

According to still further features in the described preferred embodiments the moiety is attached to or encapsulated in the peptide nanostructures.

According to still further features in the described preferred embodiments the moiety is an enzyme, the enzyme being capable of catalyzing a reaction generating the electrochemically reactive molecule.

According to still further features in the described preferred embodiments the moiety is a ligand, the ligand being capable of capturing the molecule generating the electrochemically reactive molecule.

According to another aspect of the present invention there is provided a process of preparing the electrode described herein, the process comprising subjecting the plurality of peptides to conditions which favor formation of the peptide nanostructures.

According to further features in preferred embodiments of the invention described below, the electrode further comprises a support having a surface coated with the peptide nanostructures, the process further comprising: attaching the peptide nanostructures to the surface.

According to still further features in the described preferred embodiments the attaching is performed concomitant with or subsequent to the subjecting.

According to still further features in the described preferred embodiments the process further comprising, prior to the attaching: modifying the peptide nanostructures to thereby generate a functional group thereon, the functional group being for attaching the peptide nanostructures to the surface.

According to still further features in the described preferred embodiments the process further comprising, prior to, concomitant with or subsequent to the subjecting, attaching to or encapsulating in the peptide nanostructures a moiety capable of generating an electrochemically reactive molecule and/or capable of reacting with and/or capturing a molecule generating the electrochemically reactive molecule upon the electrochemical reaction.

According to an additional aspect of the present invention there is provided an electrochemical cell comprising a working electrode and a reference electrode, the working electrode being any of the electrodes described herein.

According to further features in preferred embodiments of the invention described below, the electrochemical cell further comprising an auxiliary electrode.

According to still further features in the described preferred embodiments the electrochemical cell further comprising a moiety being capable of generating an electrochemically reactive molecule and/or capable of reacting with and/or capturing a molecule generating the electrochemically reactive molecule upon the electrochemical reaction.

According to still further features in the described preferred embodiments the moiety is attached to or encapsulated in the peptide nanostructures.

According to yet an additional aspect of the present invention there is provided a detector comprising: any of the electrodes described herein; and a detecting unit attached to the electrode and being capable of detecting a response current resulting from the electrochemical reaction.

According to further features in preferred embodiments of the invention described below, the detector further comprising a reference electrode.

According to still further features in the described preferred embodiments the detector further comprising an auxiliary electrode.

According to still further features in the described preferred embodiments the detector further comprising a voltage source being capable of applying a gating voltage to the electrode.

According to still further features in the described preferred embodiments the detector further comprising a moiety being capable of generating an electrochemically reactive molecule and/or capable of reacting with and/or capturing a molecule generating the electrochemically reactive molecule upon the electrochemical reaction.

According to still further features in the described preferred embodiments the moiety forms a part of a first member of a binding pair and the molecule generating the electrochemically reactive molecule forms a part of a second member of a binding pair.

According to still further features in the described preferred embodiments the binding pair is selected from the group consisting of enzyme-substrate, receptor-ligand, antibody-antigen and biotin-avidin.

According to still further features in the described preferred embodiments the moiety is an enzyme, the enzyme being capable of catalyzing a reaction generating the electrochemically reactive molecule.

According to still further features in the described preferred embodiments the enzyme is attached to or encapsulated in the peptide nanostructures.

According to still further features in the described preferred embodiments the moiety is a ligand, the ligand being capable of capturing a molecule generating the electrochemically active molecule.

According to still further features in the described preferred embodiments the ligand is attached to or encapsulated in the peptide nanostructures.

According to still an additional aspect of the present invention there is provided a sensor array comprising a plurality of electrochemical cells each comprising, as a working electrode, any of the electrodes described herein.

According to further features in preferred embodiments of the invention described below, each of the plurality of electrochemical cells further includes a reference electrode.

According to still further features in the described preferred embodiments each of the plurality of electrochemical cells further includes an auxiliary electrode.

According to still further features in the described preferred embodiments the sensor array includes a support having a plurality of chambers, and whereas each of the plurality of electrochemical cells is disposed within a specific chamber of the plurality of chambers.

According to a further aspect of the present invention there is provided a method of electrochemically detecting an analyte is a sample, the method comprising: contacting the sample with a detector as described herein; and measuring the response current.

According to further features in preferred embodiments of the invention described below, the analyte is an electrochemically reactive molecule.

According to still further features in the described preferred embodiments the analyte generates an electrochemically reactive molecule.

According to still further features in the described preferred embodiments the analyte forms a part of a first member of a binding pair and the detector further comprises a second member of the binding pair.

According to still further features in the described preferred embodiments the binding pair is selected from the group consisting of enzyme-substrate, receptor-ligand, antibody-antigen and biotin-avidin.

According to still further features in the described preferred embodiments the contacting generates an electrochemically reactive molecule upon interaction between the first and the second members of the binding pairs.

According to still further features in the described preferred embodiments the second member of the binding pair is attached to or encapsulated in the peptide nanostructures.

According to yet a further aspect of the present invention there is provided a kit for detecting an analyte in a sample, the kit comprising the detector of claim 31 being packaged in a packaging material and identified in print, in or on the packaging material, for use in detecting the analyte.

According to further features in preferred embodiments of the invention described below, the analyte is an electrochemically reactive molecule.

According to still further features in the described preferred embodiments the analyte generates an electrochemically reactive moiety.

According to still further features in the described preferred embodiments the analyte forms a part of a first member of a binding pair and the detector further comprises a second member of the binding pair.

According to still further features in the described preferred embodiments the binding pair is selected from the group consisting of enzyme-substrate, receptor-ligand, antibody-antigen and biotin-avidin.

According to still further features in the described preferred embodiments the contacting produces an electrochemically reactive molecule upon interaction between the first and the second members of the binding pairs.

According to still further features in the described preferred embodiments the second member of the binding pair is attached to or encapsulated in the peptide nanostructures.

According to still further features in the described preferred embodiments the detector and the second member of the binding pair are individually packaged within the kit.

The present invention successfully addresses the shortcomings of the presently known configurations by providing a peptide nanostructure-coated electrode which can be used in electrochemical detection of a variety of molecules.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

As used herein the term "about" refers to ±10%.

As used herein, the singular form "a", "an" and "the" include plural references unless the context clearly dictates otherwise. For example, the term "a protein" or "at least one protein" may include a plurality of proteins, including mixtures thereof.

Throughout this disclosure, various aspects of this invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

As used herein throughout, the term "comprising" means that other steps and ingredients that do not affect the final result can be added. This term encompasses the terms "consisting of" and "consisting essentially of".

The term "method" or "process" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

(FIG. 1*a* illustrates an overall view of detector (10); and FIG. 1*b* illustrates the working electrode (14) coated with peptide nanostructures (16) in the electrochemical cell (12));

FIGS. 5*a-c* present scanning electron microscope images (scale bar—100 mm) of a control electrode (FIG. 5*a*), a peptide-nanotube modified electrode (FIG. 5*b*), and a peptide nanotube electrode following treatment with proteinase K (FIG. 5*c*);

FIG. 6 presents a bar graph illustrating current response of an unmodified electrode (bars 4-6) and a PNT-coated electrode (bars 1-3) to the addition of 10 mM hydrogen peroxide at various applied potentials (n=4);

DESCRIPTION OF THE PREFERRED EMBODIMENTS

Figures 1A, 1B:
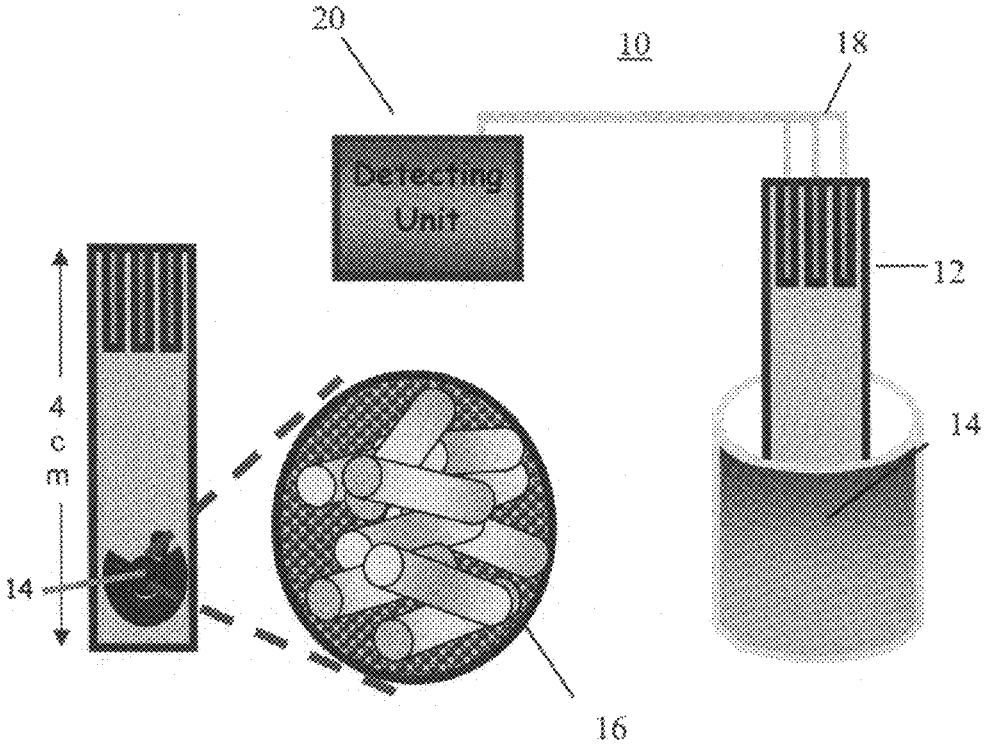
FIGS. 1*a-b* illustrate one embodiment of a molecule detector fabricated according to the teachings of the present invention

The present invention is of peptide nanostructures-containing electrodes which can be used in electrochemical sensing applications. Specifically, the present invention can be used in biosensing applications. The present invention is further of processes of generating such peptide nanostructures-containing electrodes and of electrochemical cells, detectors and arrays comprising such electrodes. The present invention is further of methods and kits utilizing electrochemical cells, detectors and arrays comprising such electrodes for detecting various analytes.

The principles and operation of the present invention may be better understood with reference to the drawings and accompanying descriptions.

Before explaining at least one embodiment of the invention in detail, it is to be understood that the invention is not limited in its application to the details set forth in the following description or exemplified by the Examples. The invention is capable of other embodiments or of being practiced or carried out in various ways. Also, it is to be understood that the phraseology and terminology employed herein is for the purpose of description and should not be regarded as limiting.

Self-assembled nanostructures allow controlled fabrication of novel nanoscopic materials and devices. Nanotubular structures are particularly important structural elements as they may serve in numerous applications, for example, as nanowires and nanoscaffolds. Most widely used nanotubes are made of carbon or peptide assemblers (i.e., building blocks). While carbon nanotubes suffer from major structural defects including branching and bending resulting in spatial structures with unpredictable electronic, molecular and structural properties, peptide-based nanotubes form well-ordered crystals, networks, or bundles of nanostructures.

Use of carbon nanotube-coated electrodes in electrochemical sensing applications has been previously described (Fabrication of Carbon Nanotube Electrodes for Bio-Nano-Electronic Devices; Sasaki et al. Proc. Int. Symp. Super-Functionality Organic Devices IPAP Conf. Series 6 pp. 168-170). Although similar use of peptide-based nanostructures has been previously suggested, to date, applicability of peptide nanostructures in electrochemical applications has not been shown.

Recently, it was uncovered that aromatic peptides (e.g., diphenylalanine) are capable of forming planar, fibrillar, tubular and spherical nanostructures, which can be used in numerous mechanical, electrical, chemical, optical and biotechnological systems (see, for example, WO 2004/052773, WO 2004/060791, PCT/IL2005/000589, and U.S. patent application Ser. Nos. 11/148,262 and 11/148,266, which are all incorporated by reference as if fully set forth herein).

While trying to modulate the electrostatic interactions between the peptides composing such nanostructures, it has been uncovered that end-capping modified peptides can be utilized for forming the nanostructures. Thus, WO 2006/027780, for example, teaches that such a modification does not affect the formation of the nanostructure; that the overall charge of the peptide, and therefore of the resulting nanostructure, can be turned positive, negative of nullified; and that by modulating the chemical structure of the end-capping moiety of the modified peptides, features such as the shape and chemical or physical properties of the nanostructure can be controlled.

To examine electrochemical properties of peptide nanostructures, the present inventors generated peptide nanostructures-coated electrodes by depositing peptide nanostructures onto various electrode surfaces. As is clearly illustrated in the Examples section that follows, the present inventors have conclusively shown that peptide nanostructures-coated electrodes are highly suitable for use as electrochemical sensing electrodes. These electrodes exhibited a remarkable sensitivity, and particularly a substantially increased sensitivity compared to commonly used electrodes.

Thus, according to one aspect of the present invention, there is provided an electrode which includes a plurality of peptide nanostructures. Such an electrode is capable of conducting a response current resulting from an electrochemical reaction in a proximity thereof.

The phrase "electrochemical reaction", as used herein, refers to a chemical reaction that involves an electron transfer under controlled electrical conditions. An electrochemical reaction typically involves one or more electrochemically reactive substances (or molecules), whereas the electron transfer is donated or accepted by the substance, typically via oxidation and/or reduction (redox), which occurs under controlled electrical conditions in an electrochemical cell. Each electrochemical event, namely an electron transfer, contributes to the electrical current resulting from the electrochemical reaction.

An "electrochemically reactive molecule", therefore describes a substance which can accept or donate at least one electron during an electrochemical reaction.

The term "proximity" describes a distance and conditions that allow an electron transfer that is produced in the electrochemical reaction to interact with the electrode.

The peptide nanostructures are designed so as to allow charge delocalization, and hence a response current.

Thus, when a molecule undergoes an electrochemical reaction, for example oxidation, the electron donated by the molecule interacts with the delocalized charge of the peptide nanostructure, and an electrical current is produced.

The presence of the peptide nanostructures provides a large surface area that enables efficient electron transfer from an electrochemically reactive molecule to the nanostructures and hence provides for high sensitivity of the electrochemical system.

Indeed, as is further demonstrated in the Examples section that follows, the electrodes describes herein were found to exhibit an enhanced response current as compared to commonly used electrodes, as is further detailed hereinbelow.

The peptide nanostructures in the electrode are composed of a plurality of peptides, which are self-assembled so as to form the nanostructure.

The nanostructures can be, for example, planar, fibrillar, spherical and/or tubular nanostructures and are preferably tubular. The latter is referred to herein and in related art as "peptide nanotubes". Such nanotubes typically have a diameter that does not exceed 500 nm.

The phrase "peptide nanotube" is also referred to herein by its abbreviation "PNT". The phrases "peptide nanotubes" or "PNTs" and "peptide nanotube structures are used herein interchangeably.

The length of each of the nanostructures typically ranges from about 100 nm to about 100 microns.

Although such an electrode can be composed solely of peptide nanostructures, as is further described herein, the peptide nanostructures are preferably attached to a surface of a conducting (e.g. metal) or non-conducting (e.g. silicon oxide) support.

Attachment of the peptide nanostructures to the surface of such a support can be performed via covalent or non-covalent bonds. Thus, the peptide nanostructures can be attached directly to the surface, via, for example, electrostatic interactions, hydrogen bond interactions, surface interactions (e.g., physical interactions such as absorbance), coordinative interactions and/or covalent interactions, depending on the chemical and/or morphological structure of both the surface and the peptide nanostructures. Alternatively, the attachment of the peptide nanostructures to the surface can be mediated by chemical moieties or by affinity binding pairs such as, biotin-avidin, which allow performing the attachment via the above-described interactions.

An electrode which comprises a support and the peptide nanotube structures attached to the surface of the support is also referred to herein interchangeably as peptide nanotubes (PNT)-based electrode, peptide nanotubes (PNT)-coated electrode, or peptide nanotubes (PNT)-modified electrode.

As detailed hereinbelow, such an electrode can be beneficially utilized as a working electrode in an electrochemical cell. A working electrode acts as a measuring electrode, through which electrons produced by an electrochemical reaction are transferred to a measuring unit. A working electrode must be an electronic conductor. It must also be electrochemically inert (i.e., does not generate a current in response to an applied potential) over a wide potential range (the potential window). Commonly used working electrode materials for cyclic voltammetry include platinum, gold, mercury, and glassy carbon, pyrolytic graphite. Other materials (e.g., semiconductors and other metals) are also used, for more specific applications. The choice of material depends upon the potential window required (e.g., mercury can only be used for negative potentials, due to oxidation of mercury at more positive potentials), as well as the rate of electron transfer (slow electron transfer kinetics can affect the reversibility of redox behavior of a system). The rate of electron transfer can vary considerably from one material to another, even for the same analyte, due to, for example, catalytic interactions between the analyte and active species on the electrode surface.

Thus, a support surface of the electrode described herein can be composed of, for example, silicon oxide, carbon, graphite, nickel, gold, platinum, silver, indium tin oxide, or copper, or of any other material, metal and metal alloy that is suitable for use as a working electrode in an electrochemical system.

The peptide nanostructures of the electrode described herein are preferably self-assembled structures composed of a plurality of peptides.

To effectively conduct an electrochemical response current, the peptide nanostructures of the electrode of the present embodiments are preferably assembled such that electrochemically reactive moieties of the peptide nanostructures are spatially oriented in a way which enables inter-moiety transfer of electron. Thus, the peptide nanostructures are preferably assembled such that the electrochemically reactive moieties (namely, moieties that afford charge delocalization) therein are tightly packed, so as to allow an efficient charge delocalization.

Preferably, these electrochemically reactive moieties are aromatic moieties, such that the intermolecular stacking interactions between the aromatic moieties produce well-ordered, electronically active structures.

The peptide nanostructures can be assembled from several types of peptide sequences.

The term "peptide" as used herein encompasses native peptides (either degradation products, synthetically synthesized peptides or recombinant peptides) and peptidomimetics (typically, synthetically synthesized peptides), as well as peptoids and semipeptoids which are peptide analogs, which may have, for example, modifications rendering the peptides more stable while in a body or more capable of penetrating into cells. Such modifications include, but are not limited to N terminus modification, C terminus modification, peptide bond modification, including, but not limited to, $CH_2$—NH, $CH_2$—S, $CH_2$—S═O, O═C—NH, $CH_2$—O, $CH_2$—$CH_2$, S═C—NH, CH═CH or CF═CH, backbone modifications, and residue modification. Methods for preparing peptidomimetic compounds are well known in the art and are specified, for example, in Quantitative Drug Design, C. A. Ramsden Gd., Chapter 17.2, F. Choplin Pergamon Press (1992), which is incorporated by reference as if fully set forth herein. Further details in this respect are provided hereinunder.

Peptide bonds (—CO—NH—) within the peptide may be substituted, for example, by N-methylated bonds (—N($CH_3$)—CO—), ester bonds (—C(R)H—C—O—O—C(R)—N—), ketomethylene bonds (—CO—$CH_2$—), α-aza bonds (—NH—N(R)—CO—), wherein R is any alkyl, e.g., methyl, carba bonds (—$CH_2$—NH—), hydroxyethylene bonds (—CH(OH)—$CH_2$—), thioamide bonds (—CS—NH—), olefinic double bonds (—CH═CH—), retro amide bonds (—NH—CO—), peptide derivatives (—N(R)—$CH_2$—CO—), wherein R is the "normal" side chain, naturally presented on the carbon atom.

These modifications can occur at any of the bonds along the peptide chain and even at several (2-3) at the same time.

As used herein the phrase "amino acid" or "amino acids" is understood to include the 20 naturally occurring amino acids; those amino acids often modified post-translationally in vivo, including, for example, hydroxyproline, phosphoserine and phosphothreonine; and other unusual amino acids including, but not limited to, 2-aminoadipic acid, hydroxylysine, isodemosine, nor-valine, nor-leucine and omithine. Furthermore, the term "amino acid" includes both D- and L-amino acids.

Tables 1 and 2 below list naturally occurring amino acids (Table 1) and non-conventional or modified amino acids (e.g., synthetic, Table 2) which can be used with the present invention.

TABLE 1

| Amino Acid | Three-Letter Abbreviation | One-letter Symbol |
|---|---|---|
| alanine | Ala | A |
| Arginine | Arg | R |
| Asparagine | Asn | N |
| Aspartic acid | Asp | D |
| Cysteine | Cys | C |
| Glutamine | Gln | Q |
| Glutamic Acid | Glu | E |
| glycine | Gly | G |
| Histidine | His | H |
| isoleucine | Iie | I |
| leucine | Leu | L |
| Lysine | Lys | K |
| Methionine | Met | M |
| phenylalanine | Phe | F |
| Proline | Pro | P |
| Serine | Ser | S |
| Threonine | Thr | T |
| tryptophan | Trp | W |
| tyrosine | Tyr | Y |
| Valine | Val | V |
| Any amino acid as above | Xaa | X |

TABLE 2

| Non-conventional amino acid | Code |
|---|---|
| α-aminobutyric acid | Abu |
| α-amino-α-methylbutyrate | Mgabu |
| aminocyclopropane-carboxylate | Cpro |
| aminoisobutyric acid | Aib |
| aminonorbornyl-carboxylate | Norb |
| cyclohexylalanine | Chexa |
| cyclopentylalanine | Cpen |
| D-alanine | Dal |
| D-arginine | Darg |
| D-aspartic acid | Dasp |
| D-cysteine | Dcys |
| D-glutamine | Dgln |
| D-glutamic acid | Dglu |
| D-histidine | Dhis |
| D-isoleucine | Dile |
| D-leucine | Dleu |
| D-lysine | Dlys |
| D-methionine | Dmet |
| D-ornithine | Dorn |
| D-phenylalanine | Dphe |
| D-proline | Dpro |
| D-serine | Dser |
| D-threonine | Dthr |
| D-tryptophan | Dtrp |
| D-tyrosine | Dtyr |
| D-valine | Dval |
| D-α-methylalanine | Dmala |
| D-α-methylarginine | Dmarg |
| D-α-methylasparagine | Dmasn |
| D-α-methylaspartate | Dmasp |
| D-α-methylcysteine | Dmcys |
| D-α-methylglutamine | Dmgln |
| D-α-methylhistidine | Dmhis |
| D-α-methylisoleucine | Dmile |
| D-α-methylleucine | Dmleu |
| D-α-methyllysine | Dmlys |
| D-α-methylmethionine | Dmmet |
| D-α-methylornithine | Dmorn |
| D-α-methylphenylalanine | Dmphe |
| D-α-methylproline | Dmpro |

TABLE 2-continued

| Non-conventional amino acid | Code |
|---|---|
| D-α-methylserine | Dmser |
| D-α-methylthreonine | Dmthr |
| D-α-methyltryptophan | Dmtrp |
| D-α-methyltyrosine | Dmty |
| D-α-methylvaline | Dmval |
| D-α-methylalnine | Dnmala |
| D-α-methylarginine | Dnmarg |
| D-α-methylasparagine | Dnmasn |
| D-α-methylasparatate | Dnmasp |
| D-α-methylcysteine | Dnmcys |
| D-N-methylleucine | Dnmleu |
| D-N-methyllysine | Dnmlys |
| N-methylcyclohexylalanine | Nmchexa |
| D-N-methylornithine | Dnmorn |
| N-methylglycine | Nala |
| N-methylaminoisobutyrate | Nmaib |
| N-(1-methylpropyl)glycine | Nile |
| N-(2-methylpropyl)glycine | Nile |
| N-(2-methylpropyl)glycine | Nleu |
| D-N-methyltryptophan | Dnmtrp |
| D-N-methyltyrosine | Dnmtyr |
| D-N-methylvaline | Dnmval |
| γ-aminobutyric acid | Gabu |
| L-t-butylglycine | Tbug |
| L-ethylglycine | Etg |
| L-homophenylalanine | Hphe |
| L-α-methylarginine | Marg |
| L-α-methylaspartate | Masp |
| L-α-methylcysteine | Mcys |
| L-α-methylglutamine | Mgln |
| L-α-methylhistidine | Mhis |
| L-α-methylisoleucine | Mile |
| D-N-methylglutamine | Dnmgln |
| D-N-methylglutamate | Dnmglu |
| D-N-methylhistidine | Dnmhis |
| D-N-methylisoleucine | Dnmile |
| D-N-methylleucine | Dnmleu |
| D-N-methyllysine | Dnmlys |
| N-methylcyclohexylalanine | Nmchexa |
| D-N-methylornithine | Dnmorn |
| N-methylglycine | Nala |
| N-methylaminoisobutyrate | Nmaib |
| N-(1-methylpropyl)glycine | Nile |
| N-(2-methylpropyl)glycine | Nleu |
| D-N-methyltryptophan | Dnmtrp |
| D-N-methyltyrosine | Dnmtyr |
| D-N-methylvaline | Dnmval |
| γ-aminobutyric acid | Gabu |
| L-t-butylglycine | Tbug |
| L-ethylglycine | Etg |
| L-homophenylalanine | Hphe |
| L-α-methylarginine | Marg |
| L-α-methylaspartate | Masp |
| L-α-methylcysteine | Mcys |
| L-α-methylglutamine | Mgln |
| L-α-methylhistidine | Mhis |
| L-α-methylisoleucine | Mile |
| L-α-methylleucine | Mleu |
| L-α-methylmethionine | Mmet |
| L-α-methylnorvaline | Mnva |
| L-α-methylphenylalanine | Mphe |
| L-α-methylserine | Mser |
| L-α-methylvaline | Mtrp |
| L-α-methylleucine | Mval Nnbhm |
| N-(N-(2,2-diphenylethyl)carbamylmethyl-glycine | Nnbhm |
| 1-carboxy-1-(2,2-diphenylethylamino)cyclopropane | Nmbc |
| L-N-methylalanine | Nmala |
| L-N-methylarginine | Nmarg |
| L-N-methylasparagine | Nmasn |
| L-N-methylaspartic acid | Nmasp |
| L-N-methylcysteine | Nmcys |
| L-N-methylglutamine | Nmgin |
| L-N-methylglutamic acid | Nmglu |
| L-N-methylhistidine | Nmhis |
| L-N-methylisolleucine | Nmile |
| L-N-methylleucine | Nmleu |
| L-N-methyllysine | Nmlys |

TABLE 2-continued

| Non-conventional amino acid | Code |
|---|---|
| L-N-methylmethionine | Nmmet |
| L-N-methylnorleucine | Nmnle |
| L-N-methylnorvaline | Nmnva |
| L-N-methylornithine | Nmorn |
| L-N-methylphenylalanine | Nmphe |
| L-N-methylproline | Nmpro |
| L-N-methylserine | Nmser |
| L-N-methylthreonine | Nmthr |
| L-N-methyltryptophan | Nmtrp |
| L-N-methyltyrosine | Nmtyr |
| L-N-methylvaline | Nmval |
| L-N-methylethylglycine | Nmetg |
| L-N-methyl-t-butylglycine | Nmtbug |
| L-norleucine | Nle |
| L-norvaline | Nva |
| α-methyl-aminoisobutyrate | Maib |
| α-methyl-γ-aminobutyrate | Mgabu |
| α-methylcyclohexylalanine | Mchexa |
| α-methylcyclopentylalanine | Mcpen |
| α-methyl-α-napthylalanine | Manap |
| α-methylpenicillamine | Mpen |
| N-(4-aminobutyl)glycine | Nglu |
| N-(2-aminoethyl)glycine | Naeg |
| N-(3-aminopropyl)glycine | Norn |
| N-amino-α-methylbutyrate | Nmaabu |
| α-napthylalanine | Anap |
| N-benzylglycine | Nphe |
| N-(2-carbamylethyl)glycine | Ngln |
| N-(carbamylmethyl)glycine | Nasn |
| N-(2-carboxyethyl)glycine | Nglu |
| N-(carboxymethyl)glycine | Nasp |
| N-cyclobutylglycine | Ncbut |
| N-cycloheptylglycine | Nchep |
| N-cyclohexylglycine | Nchex |
| N-cyclodecylglycine | Ncdec |
| N-cyclododeclglycine | Ncdod |
| N-cyclooctylglycine | Ncoct |
| N-cyclopropylglycine | Ncpro |
| N-cycloundecylglycine | Ncund |
| N-(2,2-diphenylethyl)glycine | Nbhm |
| N-(3,3-diphenylpropyl)glycine | Nbhe |
| N-(3-indolylyethyl)glycine | Nhtrp |
| N-methyl-γ-aminobutyrate | Nmgabu |
| D-N-methylmethionine | Dnmmet |
| N-methylcyclopentylalanine | Nmcpen |
| D-N-methylphenylalanine | Dnmphe |
| D-N-methylproline | Dnmpro |
| D-N-methylserine | Dnmser |
| D-N-methylserine | Dnmser |
| D-N-methylthreonine | Dnmthr |
| N-(1-methylethyl)glycine | Nva |
| N-methyla-napthylalanine | Nmanap |
| N-methylpenicillamine | Nmpen |
| N-(p-hydroxyphenyl)glycine | Nhtyr |
| N-(thiomethyl)glycine | Ncys |
| penicillamine | Pen |
| L-α-methylalanine | Mala |
| L-α-methylasparagine | Masn |
| L-α-methyl-t-butylglycine | Mtbug |
| L-methylethylglycine | Metg |
| L-α-methylglutamate | Mglu |
| L-α-methylhomo phenylalanine | Mhphe |
| N-(2-methylthioethyl)glycine | Nmet |
| N-(3-guanidinopropyl)glycine | Narg |
| N-(1-hydroxyethyl)glycine | Nthr |
| N-(hydroxyethyl)glycine | Nser |
| N-(imidazolylethyl)glycine | Nhis |
| N-(3-indolylyethyl)glycine | Nhtrp |
| N-methyl-γ-aminobutyrate | Nmgabu |
| D-N-methylmethionine | Dnmmet |
| N-methylcyclopentylalanine | Nmcpen |
| D-N-methylphenylalanine | Dnmphe |
| D-N-methylproline | Dnmpro |
| D-N-methylserine | Dnmser |
| D-N-methylthreonine | Dnmthr |
| N-(1-methylethyl)glycine | Nval |
| N-methyla-napthylalanine | Nmanap |

TABLE 2-continued

| Non-conventional amino acid | Code |
|---|---|
| N-methylpenicillamine | Nmpen |
| N-(p-hydroxyphenyl)glycine | Nhtyr |
| N-(thiomethyl)glycine | Ncys |
| penicillamine | Pen |
| L-α-methylalanine | Mala |
| L-α-methylasparagine | Masn |
| L-α-methyl-t-butylglycine | Mtbug |
| L-methylethylglycine | Metg |
| L-α-methylglutamate | Mglu |
| L-α-methylhomophenylalanine | Mhphe |
| N-(2-methylthioethyl)glycine | Nmet |
| L-α-methyllysine | Mlys |
| L-α-methylnorleucine | Mnle |
| L-α-methylornithine | Morn |
| L-α-methylproline | Mpro |
| L-α-methylthreonine | Mthr |
| L-α-methyltyrosine | Mtyr |
| L-N-methylhomophenylalanine | Nmhphe |
| N-(N-(3,3-diphenylpropyl)carbamylmethyl(1)glycine | Nnbhe |

Natural aromatic amino acids, Trp, Tyr and Phe, may be substituted for synthetic non-natural acid such as Phenylglycine, TIC, naphthylalanine (Nal), phenylisoserine, threoninol, ring-methylated derivatives of Phe, halogenated derivatives of Phe or O-methyl-Tyr and β-amino acids.

The peptides may include one or more modified amino acids or one or more non-amino acid monomers (e.g. fatty acids, complex carbohydrates etc).

The peptides utilized for forming the nanostructures described herein are preferably linear peptides, although it will be appreciated that in cases where cyclization does not severely interfere with peptide characteristics, cyclic forms of the peptide can also be utilized.

Since self-assembly kinetics are largely determined by the specific residue composition and possibly the length of the peptides generated, the peptides composing the nanostructures described herein can be both longer peptides (e.g., 10-50 amino acid residues) or preferably shorter peptides (e.g., 2-15 amino acid residues). More preferably, the peptides composing the nanostructures described herein are short peptides of less than 10 amino acid residues, more preferably less than 8 amino acid residues and more preferably are peptides of 2-7 amino acid residues, and hence each peptide preferably has 2, 3, 4, 5, 6 or 7 amino acid residues).

Since, as delineated hereinabove, electron conductivity of the peptide nanostructures is preferably effected via aromatic moieties that are spatially oriented so as to allow inter-moiety electron transfer, each of the peptides composing the peptide nanostructures preferably comprises at least one aromatic amino acid residue.

These aromatic functionalities built into the peptide backbone allow the various peptide building blocks to interact also through attractive aromatic interactions, to thereby form the nanostructure.

The phrase "aromatic amino acid residue", as used herein, describes an amino acid residue that has an aromatic moiety, as defined herein, in its side-chain.

Thus, according to preferred embodiments of the present invention, each of the peptides composing the peptide nanostructures comprises the amino acid sequence X-Y or Y-X, wherein X is an aromatic amino acid residue and Y is any other amino acid residue.

According to one embodiment of this aspect of the present invention, amino acid residue Y is a polar and uncharged amino acid.

The peptides of the present invention, can be at least 3 amino acid in length and may include at least one pair of positively charged (e.g., lysine and arginine) and negatively charged (e.g., aspartic acid and glutamic acid) amino acids.

Yet additionally, the peptide of the present invention can be 4 amino acids in length and include two serine residues at the C-terminal end of the X-Y/Y-X sequence.

In a preferred embodiment of the present invention, at least one peptide in the plurality of peptides used for forming the nanostructures of the electrode is a polyaromatic peptide, comprising two or more aromatic amino acid residues. In a more preferred embodiment, at least one peptide in the plurality of peptides consists essentially of aromatic amino acid residues. In another preferred embodiment, each peptide in the plurality of peptides consists essentially of aromatic amino acid residues.

Thus, for example, the peptides used for forming the nanostructures of the electrode can include any combination of: dipeptides composed of one or two aromatic amino acid residues; tripeptides including one, two or three aromatic amino acid residues; and tetrapeptides including two, three or four aromatic amino acid residues and so on.

In a preferred embodiment of the present invention, the aromatic amino acid can be any naturally occurring or synthetic aromatic residue including, but not limited to, phenylalanine, tyrosine, tryptophan, phenylglycine, or modificants, precursors or functional aromatic portions thereof. Examples of aromatic residues which can form a part of the peptides of present invention are provided in Table 2 above.

In a preferred embodiment, one or more peptides in the plurality of peptides used for forming the nanostructures of the electrode include two amino acid residues, and hence is a dipeptide.

In another preferred embodiment, each of the peptides used for forming the nanostructures of the electrode comprises two amino acid residues and therefore the nanostructures are formed from a plurality of dipeptides.

Each of these dipeptides can include one or two aromatic amino acid residues. Preferably, each of these dipeptides includes two aromatic amino acid residues. The aromatic residues composing the dipeptide can be the same, such that the dipeptide is a homodipeptide, or different. Preferably, the nanostructures are formed from homodipeptides.

Hence, according to the presently most preferred embodiment of the present invention, each peptide in the plurality of peptides used for forming the nanostructures of the electrode is a homodipeptide composed of two aromatic amino acid residues that are identical with respect to their side-chains residue.

The aromatic amino acid residues used for forming the nanostructures of the electrode comprise an aromatic moiety, wherein the phrase "aromatic moiety" describes a monocyclic or polycyclic moiety having a completely conjugated pi-electron system. The aromatic moiety can be an all-carbon moiety or can include one or more heteroatoms such as, for example, nitrogen, sulfur or oxygen. The aromatic moiety can be substituted or unsubstituted, whereby when substituted, the substituent can be, for example, one or more of alkyl, trihaloalkyl, alkenyl, alkynyl, cycloalkyl, aryl, heteroaryl, heteroalicyclic, halo, nitro, azo, hydroxy, alkoxy, thiohydroxy, thioalkoxy, cyano and amine.

Exemplary aromatic moieties include, for example, phenyl, biphenyl, naphthalenyl, phenanthrenyl, anthracenyl, [1,10]phenanthrolinyl, indoles, thiophenes, thiazoles and, [2,2']bipyridinyl, each being optionally substituted. Thus, representative examples of aromatic moieties that can serve as the side chain within the aromatic amino acid residues described herein include, without limitation, substituted or unsubstituted naphthalenyl, substituted or unsubstituted phenanthrenyl, substituted or unsubstituted anthracenyl, substituted or unsubstituted [1,10]phenanthrolinyl, substituted or unsubstituted [2,2']bipyridinyl, substituted or unsubstituted biphenyl and substituted or unsubstituted phenyl.

The aromatic moiety can alternatively be substituted or unsubstituted heteroaryl such as, for example, indole, thiophene, imidazole, oxazole, thiazole, pyrazole, pyridine, pyrimidine, quinoline, isoquinoline, quinazoline, quinoxaline, and purine. When substituted, the phenyl, naphthalenyl or any other aromatic moiety includes one or more substituents such as, but not limited to, alkyl, trihaloalkyl, alkenyl, alkynyl, cycloalkyl, aryl, heteroaryl, heteroalicyclic, halo, nitro, azo, hydroxy, alkoxy, thiohydroxy, thioalkoxy, cyano, and amine.

As used herein, the term "alkyl" refers to a saturated aliphatic hydrocarbon including straight chain and branched chain groups. Preferably, the alkyl group has 1 to 20 carbon atoms. Whenever a numerical range; e.g., "1-20", is stated herein, it implies that the group, in this case the alkyl group, may contain 1 carbon atom, 2 carbon atoms, 3 carbon atoms, etc., up to and including 20 carbon atoms. More preferably, the alkyl is a medium size alkyl having 1 to 10 carbon atoms. Most preferably, unless otherwise indicated, the alkyl is a lower alkyl having 1 to 4 carbon atoms. The alkyl group may be substituted or unsubstituted. When substituted, the substituent group can be, for example, halo, hydroxy, cyano, nitro and amino.

A "cycloalkyl" group refers to an all-carbon monocyclic or fused ring (i.e., rings which share an adjacent pair of carbon atoms) group wherein one of more of the rings does not have a completely conjugated pi-electron system. Examples, without limitation, of cycloalkyl groups are cyclopropane, cyclobutane, cyclopentane, cyclopentene, cyclohexane, cyclohexadiene, cycloheptane, cycloheptatriene, and adamantane. A cycloalkyl group may be substituted or unsubstituted. When substituted, the substituent group can be, for example, alkyl, halo, hydroxy, cyano, nitro and amino.

An "aryl" group refers to an all-carbon monocyclic or fused-ring polycyclic (i.e., rings which share adjacent pairs of carbon atoms) groups having a completely conjugated pi-electron system. Examples, without limitation, of aryl groups are phenyl, naphthalenyl and anthracenyl. The aryl group may be substituted or unsubstituted. When substituted, the substituent group can be, for example, alkyl, cycloalkyl, halo, hydroxy, alkoxy, thiohydroxy, thioalkoxy, cyano, nitro and amino.

The term "heteroaryl" describes a monocyclic or fused ring (i.e., rings which share an adjacent pair of atoms) group having in the ring(s) one or more atoms, such as, for example, nitrogen, oxygen and sulfur and, in addition, having a completely conjugated pi-electron system. Examples, without limitation, of heteroaryl groups include pyrrole, furane, thiophene, imidazole, oxazole, thiazole, pyrazole, pyridine, pyrimidine, quinoline, isoquinoline and purine. The heteroaryl group may be substituted or unsubstituted. Substituted heteroaryl may have one or more substituents, as described hereinabove.

The term "heteroalicyclic" describes a monocyclic or fused ring group having in the ring(s) one or more atoms such as nitrogen, oxygen and sulfur. The rings may also have one or more double bonds. However, the rings do not have a completely conjugated pi-electron system. The heteroalicyclic may be substituted or unsubstituted. Substituted heteroalicyclic may have one or more substituents, as described hereinabove. Representative examples are piperidine, piperazine, tetrahydrofurane, tetrahydropyrane, morpholino and the like.

A "hydroxy" group refers to an —OH group.

An "alkoxy" group refers to both an —O-alkyl and an —O-cycloalkyl group, as defined herein.

An "aryloxy" group refers to an —O-aryl group, as defined herein.

A "thiohydroxy" group refers to a —SH group.

A "thioalkoxy" group refers to both an —S-alkyl group, and an —S-cycloalkyl group, as defined herein.

A "thioaryloxy" group refers to an —S-aryl group, as defined herein. A "carboxy" group refers to a —C(═O)—R' group, where R' is hydrogen, halo, alkyl, cycloalkyl or aryl, as defined herein.

A "thiocarboxy" or "thiol" group refers to a —C(═S)—R' group, where R' is as defined herein for R'.

A "C-carboxylate" group refers to a —C(═O)—O—R' groups, where R' is as defined herein.

A "C-thiocarboxylate" group refers to a —C(═S)—O—R' groups, where R' is as defined herein.

A "halo" group refers to fluorine, chlorine, bromine or iodine.

An "amine" group refers to an —NR'R" group where R" is as defined herein and R" is as defined for R'.

A "nitro" group refers to an —$NO_2$ group.

A "cyano" group refers to a —C≡N group.

Representative examples of homodipeptides that can be used to form the nanostructures of the electrode described herein include, without limitation, a naphthylalanine-naphthylalanine dipeptide, phenanthrenylalanine-phenanthrenylalanine dipeptide, anthracenylalanine-anthracenylalanine dipeptide, [1,10]phenanthrolinylalanine-[1,10]phenanthrolinylalanine dipeptide, [2,2']bipyridinylalanine-[2,2']bipyridinylalanine dipeptide, (pentahalo-phenylalanine)-(pentahalo-phenylalanine) dipeptide, phenylalanine-phenylalanine dipeptide, (amino-phenylalanine)-(amino-phenylalanine) dipeptide, (dialkylamino-phenylalanine)-(dialkylamino-phenylalanine) dipeptide, (halophenylalanine)-(halophenylalanine) dipeptide, (alkoxy-phenylalanine)-(alkoxy-phenylalanine) dipeptide, (trihalomethyl-phenylalanine)-(trihalomethyl-phenylalanine) dipeptide, (4-phenyl-phenylalanine)-(4-phenyl-phenylalanine) dipeptide and (nitro-phenylalanine)-(nitro-phenylalanine) dipeptide.

According to the presently most preferred embodiment of the present invention, the peptide nanostructures are composed from a plurality of diphenylalanine (Phe-Phe) homodipeptides.

According to preferred embodiments of the present invention, one or more peptides in the plurality of peptides used to form the nanostructures of the electrode, as described herein, is an end-capping modified peptide.

The phrase "end-capping modified peptide", as used herein, refers to a peptide which has been modified at the N-(amine) terminus and/or at the C-(carboxyl) terminus thereof. The end-capping modification refers to the attachment of a chemical moiety to the terminus, so as to form a cap. Such a chemical moiety is referred to herein as an end-capping moiety and is typically also referred to herein and in the art, interchangeably, as a peptide protecting moiety or group.

The phrase "end-capping moiety", as used herein, refers to a moiety that when attached to the terminus of the peptide, modifies the end-capping. The end-capping modification typically results in masking the charge of the peptide terminus, and/or altering chemical features thereof, such as, hydrophobicity, hydrophilicity, reactivity, solubility and the like. Examples of moieties suitable for peptide end-capping modification can be found, for example, in Green et al., "Protective Groups in Organic Chemistry", (Wiley, 2.sup.nd ed. 1991) and Harrison et al., "Compendium of Synthetic Organic Methods", Vols. 1-8 (John Wiley and Sons, 1971-1996).

Representative examples of N-terminus end-capping moieties include, but are not limited to, formyl, acetyl (also denoted herein as "Ac"), trifluoroacetyl, benzyl, benzyloxycarbonyl (also denoted herein as "Cbz"), tert-butoxycarbonyl (also denoted herein as "Boc"), trimethylsilyl (also denoted "TMS"), 2-trimethylsilyl-ethanesulfonyl (also denoted "SES"), trityl and substituted trityl groups, allyloxycarbonyl, 9-fluorenylmethyloxycarbonyl (also denoted herein as "Fmoc"), and nitro-veratryloxycarbonyl ("NVOC").

Representative examples of C-terminus end-capping moieties are typically moieties that lead to acylation of the carboxy group at the C-terminus and include, but are not limited to, benzyl and trityl ethers as well as alkyl ethers, tetrahydropyranyl ethers, trialkylsilyl ethers, allyl ethers, monomethoxytrityl and dimethoxytrityl. Alternatively the —COOH group of the C-terminus end-capping may be modified to an amide group.

Other end-capping modifications of peptides include replacement of the amine and/or carboxyl with a different moiety, such as hydroxyl, thiol, halide, alkyl, aryl, alkoxy, aryloxy and the like, as these terms are defined herein.

In a preferred embodiment of the present invention, all of the peptides that comprise the nanostructures are end-capping modified.

End-capping moieties can be further classified by their aromaticity. Thus, end-capping moieties can be aromatic or non-aromatic.

Representative examples of non-aromatic end capping moieties suitable for N-terminus modification include, without limitation, formyl, acetyl trifluoroacetyl, tert-butoxycarbonyl, trimethylsilyl, and 2-trimethylsilyl-ethanesulfonyl. Representative examples of non-aromatic end capping moieties suitable for C-terminus modification include, without limitation, amides, allyloxycarbonyl, trialkylsilyl ethers and allyl ethers.

Representative examples of aromatic end capping moieties suitable for N-terminus modification include, without limitation, fluorenylmethyloxycarbonyl (Fmoc). Representative examples of aromatic end capping moieties suitable for C-terminus modification include, without limitation, benzyl, benzyloxycarbonyl (Cbz), trityl and substituted trityl groups.

The plurality of dipeptides composing the nanostructures of the electrode, according to preferred embodiments of present invention, can be collectively represented by the following general Formula I:

Formula I

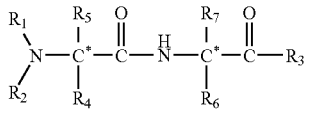

wherein:

C* is a chiral carbon having a D configuration or L configuration;

$R_1$ and $R_2$ are each independently selected from the group consisting of hydrogen, alkyl, cycloalkyl, aryl, carboxy, thiocarboxy, C-carboxylate and C-thiocarboxylate;

$R_3$ is selected from the group consisting of hydroxy, alkoxy, aryloxy, thiohydroxy, thioalkoxy, thioaryloxy, halo and amine; and each of $R_4$-$R_7$ is independently selected from the group consisting of hydrogen, alkyl, cycloalkyl, aryl, heteroaryl, heteroalicyclic, hydroxy, thiohydroxy (thiol), alkoxy, aryloxy, thioalkoxy, thioaryloxy, C-carboxylate, C-thiocarboxylate, N-carbamate, N-thiocarbamate, hydrazine, guanyl, and guanidine, as these terms are defined herein, provided that at least one of $R_4$-$R_7$ comprises an aromatic moiety, as defined herein.

Each of $R_4$-$R_7$ can further be, however, any other substituent, as long as at least one comprises an aromatic moiety.

Each of $R_1$-$R_3$ can further be any of the end-capping moieties described herein.

The term "N-carbamate" describes an R"OC(═O)—NR'group, with R' and R" as defined herein.

The term "N-thiocarbamate" describes an R"OC(═S)NR'— group, with R' and R" as defined herein.

The term "guanyl" describes a R'R"NC(═N)— end group or a —R'NC(═N)— linking group, as these phrases are defined hereinabove, where R' and R" are as defined herein.

The term "guanidine" describes a —R'NC(═N)—NR"R'" end group or a —R'NC(═N)—NR"— linking group, as these phrases are defined hereinabove, where R', R" and R'" are as defined herein.

The term "hydrazine" describes a —NR'—NR"R'" end group or a —NR'—NR" linking group, as these phrases are defined hereinabove, with R', R", and R'" as defined herein.

The peptide nanostructures can further comprise a functional group, preferably a plurality of functional groups, for forming interactions with the surface, when present in the electrode.

Thus, for attaching the peptide nanostructures to a support surface, modification of the peptide nanostructures can be effected, so as to provide modified nanostructures. Such a modification can include, for example, generation of a functional group on the nanostructure surface, which can interact with the support surface.

The functional group can be, for example, a group such as, but not limited to, thiol, hydroxy, halo, carboxylate, amine, amide, nitro, cyano, hydrazine, and the like, which can interact with the support surface via covalent, ionic, hydrogen bond or coordinative interactions, a hydrophobic moiety, such as, but not limited to, medium to high alkyls, cycloalkyls and aryls, which can interact with the support via hydrophobic interactions and/or a metal ligand, which can form an organometallic complex with a metallic surface.

Thus, for example, free amine group within the nanostructure can be reacted with iminothiolane, so as to form thiol groups on the nanostructure surface. Such thiol groups can strongly adhere to various surfaces and particularly to gold surfaces.

Similarly, nitro, hydrazine or amine groups can form complexes with copper or silver surfaces; hydroxy groups can interact with silicates, hydrophobic moieties can interact with graphite or other carbon surfaces, and so on.

Alternatively, the functional group can form a part of an affinity binding pair, as detailed hereinbelow (e.g., biotin-avidin), whereby the other part of the pair is attached to the support surface.

While the above functional groups can be generated on the nanostructures surface, it should be noted that nanostructures bearing such functional groups can be formed by selecting the appropriate peptides used for their formation, as described hereinabove.

In order to broaden and possibly enhance the detection capabilities of the present electrode, moieties that participate in the electrochemical reaction are preferably incorporated into the nanostructures or are co-coated therewith using well known chemical approaches (see the Examples section for further detail).

The peptide nanostructures can thus be further modified so as have these moieties attached thereto. Such a moiety can be, for example, a chemical moiety that is capable of generating a molecule to be detected, namely, an electrochemically reactive moiety. Alternatively, such a moiety can be a biological moiety that can be used to specifically generate a respective electrochemically reactive moiety, by, for example, reacting with a molecule generating the electrochemically reactive moiety and/or to specifically capture a molecule generating the electrochemically reactive molecule.

For example, the peptide nanostructures can have an antibody or an antibody fragment (e.g. Fab, ScFv) or an antigen attached thereto, which can be used to respectively capture specific antigens (e.g., viral antigens) or specific antibodies (e.g. disease associated antibodies), respectively.

The peptide nanostructures can have a polynucleotide or an oligonucleotide attached thereto, which can be used to capture a complementary polynucleotide.

Optionally and preferably, the moiety is an enzyme, which can be used to catalyze reactions that generate a variety of substances, as detailed hereinbelow. Examples of enzymes which can be utilized by present invention are provided in Table 3 below.

These moieties can therefore be a part of an affinity binding pair, wherein one member of the binding pair is an analyte to be detected and another member of the binding pair is attached to the nanostructure. This methodology is discussed in detail hereinbelow.

As used herein, the phrase "binding pair" describes a pair of species that have high affinity to one another, wherein the affinity results from molecular recognition and/or thermodynamically favorable interactions.

These moieties for generating or capturing a desired molecule can be either attached to the surface of the peptide nanostructures, or, can be encapsulated therein.

Attachment to the peptide nanostructures can be performed via, for example, covalent, hydrogen or hydrophobic interactions, while utilizing functional groups that are present or generated within the nanostructures. For an exemplary methodology see the Examples section that follows.

Encapsulation of these moieties in the peptide nanostructures can be performed, for example, by forming the peptide nanostructures in a solution that contains the moieties.

Further, the peptide nanostructures can be modified by being filled or coated with metallic filler or coating, using methodologies known in the art.

The peptides forming the nanostructures described herein may be synthesized by any techniques that are known to those skilled in the art of peptide synthesis. For solid phase peptide synthesis, a summary of the many techniques may be found in: Stewart, J. M. and Young, J. D. (1963), "Solid Phase Peptide Synthesis," W. H. Freeman Co. (San Francisco); and Meienhofer, J (1973). "Hormonal Proteins and Peptides," vol. 2, p. 46, Academic Press (New York). For a review of classical solution synthesis, see Schroder, G. and Lupke, K. (1965). The Peptides, vol. 1, Academic Press (New York).

In general, peptide synthesis methods comprise the sequential addition of one or more amino acids or suitably protected amino acids to a growing peptide chain. Normally, either the amino or the carboxyl group of the first amino acid is protected by a suitable protecting group. The protected or derivatized amino acid can then either be attached to an inert solid support or utilized in solution by adding the next amino acid in the sequence having the complimentary (amino or carboxyl) group suitably protected, under conditions suitable for forming the amide linkage. The protecting group is then removed from this newly added amino acid residue and the next amino acid (suitably protected) is then added, and so forth; traditionally this process is accompanied by wash steps as well. After all of the desired amino acids have been linked in the proper sequence, any remaining protecting groups (and any solid support) are removed sequentially or concurrently, to afford the final peptide compound. By simple modification of this general procedure, it is possible to add more than one amino acid at a time to a growing chain, for example, by coupling (under conditions which do not racemize chiral centers) a protected tripeptide with a properly protected dipeptide to form, after deprotection, a pentapeptide, and so forth.

According to another aspect of the present invention there is provided a process for the preparation of the electrode described herein. The process is effected by subjecting a plurality of peptides, as described herein, to conditions which favor formation of such nanostructure.

In cases where the electrode further comprises a support and the peptide nanostructures are attached to the surface of the support, the process is further effected by attaching the protein nanostructures to the surface.

The attachment of the peptide nanostructures to the support surface can be effected concomitant with or subsequent to their formation.

The conditions which favor formation of nanostructures include, for example, suitable peptides, a suitable solvent or mixture of solvents, a suitable concentration of the peptides in the solvent, a suitable temperature and a suitable reaction time.

Thus, in an exemplary process, nanotube assembly can be effected by dissolving the peptides in an organic solvent (e.g., hexafluoroisopropanol (HFIP), dimethyl sulfoxide (DMSO), acetone, dichloroacetic acid etc.) and then diluting it with water. Following a short period of time (seconds to hours), the peptides self assemble to form nanotube structures. The formed nanotube structures can then be attached to the surface of the support (covalently or non-covalently) via any one of several well known approaches (see the Example section below for specific examples). Alternatively, peptide monomers can be assembled directly on the support surface by initiating self assembly around a surface anchored peptide monomer.

For attaching the peptide nanostructures to a support surface, modification of the peptide nanostructures can be effected, as described hereinabove. Such a modification can be effected upon forming the nanostructures or by modifying the peptides used for forming the nanostructures. It should be noted that nanostructures bearing such functional groups can be formed by selecting the appropriate peptides used for their formation, as described hereinabove.

The peptide nanostructures can be optionally or in addition modified so as to have a moiety for generating, reacting with and/capturing a molecule to be detected, attached thereto or encapsulated therein, as described herein.

Attachment of such moieties to the peptide nanostructures can be performed via, for example, covalent, hydrogen or hydrophobic interactions, while utilizing functional groups that are present or generated within the nanostructures, as described herein.

Encapsulation of these moieties in the nanostructures can be performed, for example, by forming the peptide nanostructures in a solution that contains these moieties.

The electrodes described herein can therefore be designed so as to exhibit electronic, molecular and structural characteristics that are highly suitable for various applications. By manipulating the peptides utilized for forming the peptide nanostructures, and optionally the conditions for their preparation, peptide nanostructures having versatile structures (e.g., spherical, tubular or fibrillar), charge, hydrophobicity, and other characteristics can be formed, according to the desired application.

Notably, by utilizing the peptide nanostructures, an electrode that has a uniform yet desirably large surface area can be advantageously obtained.

As is demonstrated in the Examples section that follows, it has been shown that a response current measured for an electrochemical reaction carried out with a peptide nanotubes-coated electrode was 2-3 folds higher that the response current measured for the same electrochemical reaction carried out with the same, yet uncoated, electrode. Such a higher sensitivity of the electrodes described herein is attributed, inter alia, and is respective to, the increased surface area of the coated electrode. Hence, the electrodes described herein are characterized by high surface area, being higher that the respective surface area of a non-coated electrode. Thus, the surface area of an electrode upon depositing thereon the peptide nanostructures as described herein can be increased, for example, by from about 5% to about 1000%.

The peptide nanostructures preferably form an array of nanostructures, which is preferably deposited on a support surface.

The electrode of the present invention can be used in a variety of sensing (detecting) applications including, for example, external biosensors, body-implantable biosensors and the like.

As used herein throughout, the term "detecting" encompasses qualitatively and/or quantitatively determining the presence and/or level (e.g., concentration, concentration variations) of an analyte in the sample. The analyte can be, for example, a substance in a biological sample, a pollutant, a chemical warfare agent, and the likes. The analyte can be an electrochemically reactive species, or, can generate an electrochemically reactive molecule.

Due to its peptide nanostructure conducting layer, the electrode of the present invention provides several advantages when used as a working electrode in electrochemical cells. Such electrochemical cells can form a part of chemical or biological detectors (e.g. biosensors) as is further described hereinbelow.

When utilized in electrochemical cells, at least one additional electrode is also utilized since the potential of a given electrode can only be measured relative to another electrode, the potential of which must be constant (a reference electrode). In potentiometric measurements (such as measurement of pH), there is no current through the cell, and these two electrodes are sufficient (it should be noted that many pH and ion-selective electrodes used in potentiometric measurements are combination electrodes—both electrodes are contained within the same body). However, in cyclic voltammetry measurements, an external potential is applied to the cell, and the current response is measured. Precise control of the external applied potential is required, but this is generally not possible with a two electrode system, due to the potential drop across the cell due to the solution resistance [potential drop (E)=current (i)×solution resistance (R)] and the polarization of the counter electrode that is required to complete the current measuring circuit. Better potential control is achieved using a potentiostat and a 3 electrode system, in which the potential of one electrode (i.e., the present electrode) is controlled relative to a reference electrode, and the current passes between the working electrode (i.e. the present electrode) and the third electrode (an auxiliary electrode).

The major requirement for a reference electrode is that the potential does not change with time. Since the passage of current through an electrode can alter the potential, such effects are minimized for the reference electrode in the three electrode system by a) having a high input impedance for the reference electrode (thereby decreasing the current passing through the reference electrode to negligible levels) and b) using a non-polarizable electrode as the reference electrode (i.e., the passage of small currents does not alter the potential).

Thus, according to an additional aspect of the present invention, there is provided an electrochemical cell which comprises a working electrode, as described herein, comprising a plurality of peptide nanostructures, as described herein, and a reference electrode, as described herein. Preferably, the electrochemical cell further comprises an auxiliary electrode (also referred to in the art as a counter electrode).

Further preferably, the electrochemical cell further comprises an electrolytic solution, which enables electron transfer from the reacting substance and the electrode.

As is mentioned hereinabove, the peptide nanostructures-coated electrode of the present invention is preferably utilized as a working electrode in electrochemical cells. Such cells typically form a part of detectors which can be used in experimental studies as well as analytical applications.

FIGS. 1*a-b* illustrate a detector which includes an electrochemical cell utilizing the electrode of the present invention.

Detector 10 includes an electrochemical cell 12 which includes a working electrode 14, a reference electrode and an auxiliary electrode (not specifically shown). Working electrode 14 (FIG. 1*b*) is coated with peptide nanostructures 16 which are prepared as described above; the reference electrode and the auxiliary electrode are similar in type and composition to electrodes known in the art.

Working electrode 14 is fabricated from any conducting material, preferably carbon, platinum or gold and is coated with the peptide nanostructures described hereinabove. The reference electrode is typically fabricated from either calomel or silver\silver chloride. The auxiliary electrode is typically fabricated from conducting material and should have a higher surface area than that of working electrode 14. All three electrodes can be fabricated via extrusion, stamping, casting or the like of a conductor (e.g. metal) or by depositing/printing the metal on an inert substrate such as silicon oxide using methodology well known in the art.

Detector 10 also includes a detecting unit 20 (e.g. potentiostat) which is electrically connected (indicated by 18) to electrode 14, the reference electrode and the auxiliary electrode of electrochemical cell 12. Detecting unit 20 is capable of detecting and presenting a response current generated by electrode 14. Examples of detecting units which can be utilized by detector 10 of the present invention include, but are not limited to, potentiostat detectors and the like.

When utilized as a detector 10 for experimental studies (e.g. patch clamp studies), electrode 14 is typically fabricated from carbon or gold at a size range of 1 micron to 3 millimeter in diameter and coated with nanostructures of a diameter range between 50 nm to 400 nm and length from 500 nm to several hundreds of microns. The nanostructures can be used bare or they can be coated or filled with a metal, (e.g. gold) and/or attached to enzymes or ligands (covalently or non-covalently). The reference and auxiliary electrode are fabricated and positioned with respect to the working electrode as is described in the art.

When utilized as a detector 10 for analytical applications (e.g. detection of a molecule), electrode 14 is typically fabricated from carbon or gold at a size range of 1 micron to 3 millimeter in diameter and coated with nanostructures of a diameter range between 50 nm to 400 nm and length from 500 nm to several hundreds of microns. The nanostructures could be either as is, coated with metal, filled with metals, or attached to enzymes (covalently or non-covalently). The reference and auxiliary electrodes are fabricated and positioned with respect to the working electrode as is described in the art.

Use of the present electrode in detectors designed for analytical applications is presently preferred. The peptide structures provide a simple, self-assembled platform that could allow charge transport by itself, but also modified by metal coating or modification of the peptide building blocks using chemical or biochemical approaches.

The electrode of the present invention can be used as a working electrode for the detection of any electrochemically reactive molecule.

For example, a working electrode coated with peptide nanostructures modified with a ligand such as an antibody/antibody fragment (e.g. Fab, ScFv) or an antigen can be used to respectively detect specific antigens (e.g., viral antigens) or specific antibodies (e.g. disease associated antibodies).

In order to broaden and possibly enhance the detection capabilities of the present electrode, enzymes and/or ligands are preferably incorporated into the peptide nanostructures or are co-coated therewith using well known chemical approaches (see the Examples section for further detail). Examples of enzymes which can be utilized by present invention are provided in Table 3 below.

For example, an electrode co-coated with an oxidase would generate $H_2O_2$ at the electrode surface when contacted with a sample containing glucose or lactate. The $H_2O_2$ would then electrochemically react so as to produce an electron current which interacts with the peptide nanostructures to generate a measurable response current proportional to the concentration of glucose or lactate in the sample. Further description of a similar configuration is provided in Example 2 of the Examples section which follows.

An electrochemical cell constructed according to the teachings of the present invention can also be used to detect specific polynucleotide sequences by utilizing a ligand having a nucleic acid sequence complementary to that of the target polynucleotide.

The electrochemical system described herein can therefore be utilized to detect various species, by utilizing affinity binding pairs. Thus, an electrode having one member of an affinity binding pair attached thereto can be utilized to detect the other member of the binding pair (its affinity counterpart).

The affinity binding pairs can be, for example, enzyme-substrate, receptor-ligand, antigen-antibody, complementary polynucleotide sequences, or simply an avidin-biotin pair used to promote interaction between species that are linked thereto.

The above described electrode configurations can be utilized in an electrochemical cell array designed for the detection of one or more biologic molecules such as enzymes, antigens, antibodies and the like.

A typical array configuration can include a plurality of discrete electrochemical cells each including a working electrode having the peptide-nanostructures coating described hereinabove and optionally an additional moiety, ligand, enzyme-substrate or enzyme which can be used to facilitate detection of a specific molecule. By utilizing several electrochemical cells each capable of producing a response current to presence of a specific molecule, one can use such an array to detect the presence of several components in a biological sample and thus rapidly qualify and type a sample in, for example, diagnostic procedures.

The electrodes, electrochemical cells, detectors and arrays described herein can by utilized in methods, systems and kits for detecting an analyte is a sample, preferably a liquid sample. Such methods are effected by contacting a sample containing the analyte with, for example, a detector as described herein, and measuring the produced response current. Similarly, kits comprising such a detector are provided.

A detector, according to the present embodiments, which is designed to detect an analyte via, e.g., biological recognition, as described herein, can be used as a biosensor system for

TABLE 3

| Enzyme/Ligand | Molecule generated or captured | Use |
|---|---|---|
| Peroxidase | Hydrogen peroxide | Immunology, Medicine Environment |
| Glucose oxidase | glucose | Medicine, Food industry |
| Alcohol oxidase | alcohol | Food, medicine, police |
| Cholestrol oxidase | Cholesterol | Medicine, food |
| Choline oxidase | Choline, acetyl choline | Medicine, environment, detect bioteror |
| Phenol oxidase | phenol | Medicine, food, environment |
| Aminoacid oxidase | aminoacids | medicine |
| Alcohol dehydrogenase | alcohol, NAD | Food, medicine, police |
| Glucose dehydrogenase | glucose, NAD | Medicine, Food industry |
| α and β-glactosidase | lactose, p-aminophenol -D galactopyranoside | Food, molecular biology, cell markers, medicine, detection of bacteria |
| α and β glucosidase | Glucose, p-aminophenol -D glucopyranoside | Food, molecular biology, cell markers, medicine, detection of bacteria |
| α and β glucoronidase | Glucoronic acid, p-amino-phenol -D glucoronopyranoside | Food, molecular biology, cell markers, medicine, detection of bacteria |
| alkaline phosphatase | Organic phosphate | Immunology, Food, molecular biology, cell markers, medicine, detection of bacteria |

electrochemically detecting an analyte in a liquid sample. Such a biosensor system comprises a detector, as described herein, wherein the peptide nanostructures of the working electrodes include a moiety that is capable of reacting with the analyte and/or capturing the analyte to thereby generate an electrochemically reactive molecule as a detectable species, as described herein, which produces a transfer of electrons.

The biosensor presented herein is based on typical biosensors known and used in the art, and preferably includes an electrodes system in an insulating base.

The term "analyte" as used herein refers to a substance that is being analyzed for its level, namely, presence and/or concentration, in a sample. An analyte is typically a chemical or biological entity of interest which is detectable upon an electrochemical reaction and which the detector presented herein is design to detect. Examples of analytes that are typically detectable by biosensors include, without limitation, enzyme substrates. A level of an enzyme substrate analyte in a sample is determined by biosensors that include a respective enzyme or enzymatic system, whereby this level is a function of the electric current produced upon the enzymatic reaction.

The term "redox" as used herein refers to a chemical reaction in which an atom in a molecule or ion loses one or more electrons to another atom or ion of another molecule.

The phrase "oxidoreductase enzyme", which is also referred to herein interchangeably as "redox enzyme" describes an enzyme which catalyzes a reaction that involves the transfer of electrons from one molecule (the oxidant, also called the hydrogen donor or electron donor) to another molecule (the reductant, also called the hydrogen acceptor or electron acceptor), or, in short, catalyzes a redox reaction. Examples of redox enzymes include, without limitation, glucose oxidase, glucose dehydrogenase, lactate oxidase, lactate dehydrogenase, fructose dehydrogenase, galactose oxidase, cholesterol oxidase, cholesterol dehydrogenase, alcohol oxidase, alcohol dehydrogenase, bilirubinate oxidase, glucose-6-phosphate dehydrogenase, amino-acid dehydrogenase, formate dehydrogenase, glycerol dehydrogenase, acyl-CoA oxidase, choline oxidase, 4-hydroxybenzoic acid hydroxylase, maleate dehydrogenase, sarcosine oxidase, uricase, and the like.

In one embodiment of the present invention, the biosensor presented herein includes glucose oxidase, and hence the biosensor is preferably used for determining the level of glucose in a liquid sample.

The biosensor presented herein is therefore designed for detecting an analyte in a sample, which can be, for example, a physiological sample extracted from an organism.

Hence, according to another aspect of the present invention there is provided a method of electrochemically determining a level of an analyte in a sample, preferably a liquid sample. The method, according to this aspect of the present invention, is effected by contacting the detector or biosensor presented herein with the sample and measuring the response current resulting from an electrochemical reaction of the analyte in a proximity of the peptide-nanostructures-containing electrode. Use of a reference and/or use of a set of known standard samples with known concentrations can be used to convert the amperometric results into concentration of the analyte in the sample.

Preferably, the method presented herein is used for determining the level of a biological analyte which is a part of a binding pair, wherein the detector system comprises the other member of the binding pair. Preferably, the peptide nanostructures incorporate the other member of the binding pair. In one example, the analyte is glucose, and the peptide nanostructures incorporate glucose oxidase.

The biosensors and methods presented herein can be further utilized for monitoring of drugs. Such biosensors include, for example, a biosensor for theophylline using theophylline oxidase incorporated in the peptide nanostructures. In addition to medical applications, the biosensors can be used in food technology and biotechnology, e.g., for analysis of carbohydrates, organic acids, alcohols, additives, pesticides and fish/meat freshness, in environmental monitoring, e.g., for analysis of pollutants pesticides, and in defense applications, e.g., for detection of chemical warfare agents, explosives, toxins, pathogenic bacteria and the likes.

A kit, according to the present embodiments, comprises a detector as described herein, being packaged in a packaging material and identified in print, in or on the packaging material, for use in detecting an analyte in a sample, as described herein. Optionally and preferably, the detector further comprises a moiety capable of generating, or of reacting with and/or capturing a molecule capable of generating, an electrochemically reactive moiety. Such a moiety can be individually packaged within the kit or can be incorporated (attached to or encapsulated in) to the peptide nanostructures in the working electrode. Such kits are highly beneficial for "on the spot" analyses of various substances.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Reference is now made to the following examples, which together with the above descriptions, illustrate the invention in a non limiting fashion.

Example 1

Fabrication and Practice of a Peptide Nanotube-Coated Electrode

Materials and Experimental Methods:

Hydrogen Peroxide solution 30% ($H_2O_2$), $K_3[Fe(CN)_6]$, KCl, $K_2HPO_4$ and $KH_2PO_4$ were obtained from Merck; 4-Acetamidophenol and $K_4[Fe(CN)_6]$ were purchased from Fluka; Purified horse radish peroxidase (HRP) was obtained from Sigma; Phe-Phe peptides were purchase from Bachem; All solutions used herein were prepared with double-distilled water.

Preparation of Peptide Nanotubes:

Fresh stock solutions were prepared by dissolving lyophilized form of the peptides in 1,1,1,3,3,3-hexafluoro-2-propanol at a concentration of 100 mg/ml (Reches and Gazit, 2003). Fresh stock solutions were prepared for each experiment to avoid pre-aggregation. The assembly of the peptide nanotubes was performed at the optimal concentration of 2 mg/ml which leads to favorable assembly of tubular structures, as was previously described (Reches and Gazit 2003 and Song et al. 2004).

Electrodes:

Screen-printed electrodes were purchased from Gwent Electronics. Each screen-printed electrode consisted of a carbon-ink working electrode, an Ag/AgCl reference electrode, and a carbon-ink counter (auxiliary) electrode. The electrodes were printed on an underlying ceramic support.

Measurements:

Measurements were performed using an EG&G potentiostat interfaced to a PC system equipped with PAR M270 software (Rishpon and Ivnitski 1997). Cyclic voltammetry experiments were conducted at a 50 mV/sec scan rate against the Ag/AgCl reference electrode in an unstirred solution. Chronoamperometric experiments were conducted at a constant applied potential of 0.22V for $K_4[Fe(CN)_6]$ additions and −0.05V for $H_2O_2$ additions. Measurements of $K_4[Fe(CN)_6]$ and $K_3[Fe(CN)_6]$ were conducted in a 0.1M KCl solution and the measurements of peroxidase activity were conducted in phosphate buffer at pH 5.8. The solution was stirred during the chronoamperometric experiment at a constant speed of 100 rpm using a magnetic stirrer. All experiments were carried out at room temperature.

Preparation of a Peptide Nanotube-Coated Electrode:

An aliquot (2 ml) of peptide-nanotubes solution at a concentration of 2 mg/ml was deposited on the surface of the working electrode and allowed to dry at room temperature for 60 minutes. Scanning electron microscope images were taken prior to and following the experiment to verify the presence of the peptide nanotubes on the electrode.

Scanning Electron Microscopy:

Modified electrodes were coated with gold. Scanning electron microscopy images were obtained using a JSM JEOL 6300 SEM operating at 5 kV.

Digestion of Peptide Nanotube Structures by Proteinase K:

Fresh stock solutions of the peptides were diluted to a final concentration of 2 mg/ml. The nanotubes were then incubated for 1 hour with a solution of Proteinase K (20 μg/ml) at 37° C. and examined under the same experimental procedures.

Figure 2A:
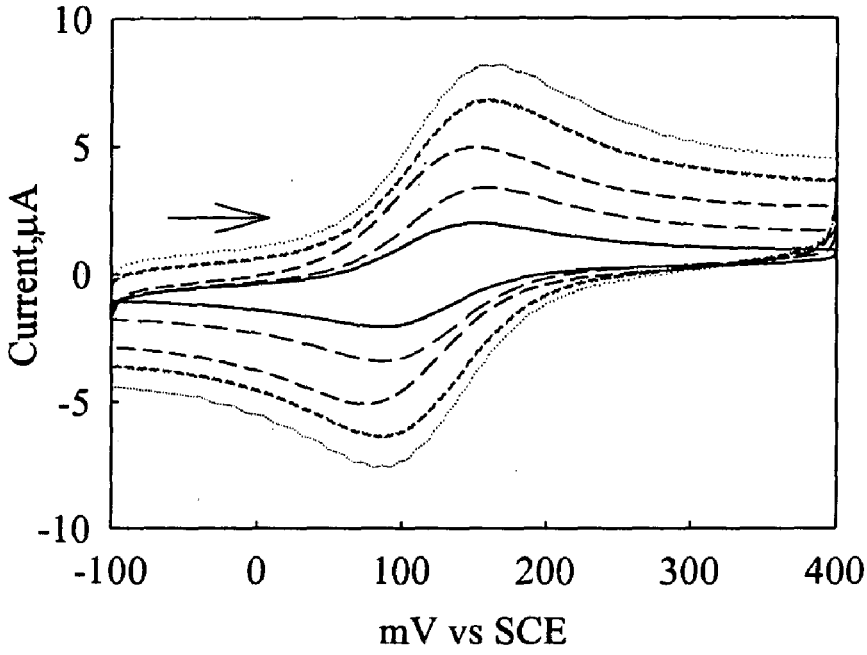
FIGS. 2*a-b* represent the cyclic voltammetry response of screen-printed electrode to 0.06 mM $K_4[Fe(CN)_6]$ and $K_3[Fe(CN)_6]$ with (FIG. 2*a*) and without (FIG. 2*b*) modification with peptide nanotubes (the plotted lines represent different scan rates; from inner to outer: 10, 25, 50, 75 and 100 mV/sec; the arrow indicates the initial scan direction.
Figure 2B:
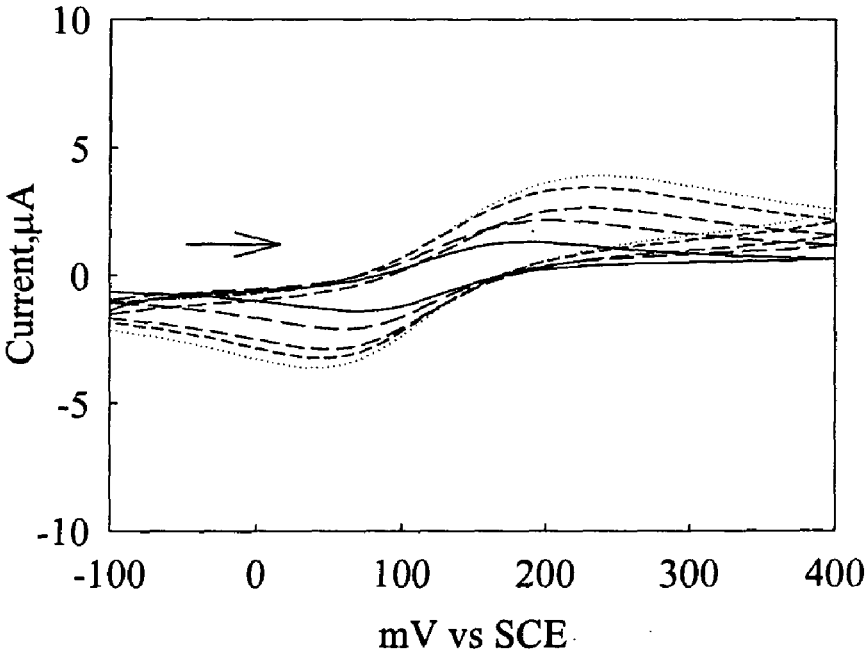

Results:

FIGS. 2*a-b* depict typical cyclic voltammograms (CVs) obtained from PNT-modified electrodes (FIG. 2*a*) and from untreated control electrodes (FIG. 2*b*) following addition of potassium hexacyanoferrate. The presence of well-defined, reversible anodic and cathodic peaks indicates improved electrochemical reactivity for the potassium hexacyanoferrate oxidation-reduction reaction on the PNT based electrodes. The cyclic voltammogram shows a characteristic anodic peak at Epa=0.22 V vs. Ag/AgCl for a bare electrode and at 0.17 V for peptide nanotube modified electrode and the complementary cathodic peak at Epc=0.08 V for bare and 0.1 V for modified electrode. The difference between Epa and Epc (dEp) decreased from 0.14 V for bare screen printed to 0.07 V in peptide nanotubes modified electrode. The results demonstrate that the PNT coating significantly improves the electrochemical fingerprint of the electrode.

The results appear to be highly reproducible as no significant changes of the peak current were detected after the potential was swept from −0.1 to +0.4 V and back at a scan rate of 50 mV/sec for 50 cycles. This indicates that the peptide nanotubes are well adhered to the graphite electrode surface. Furthermore, different electrodes show very similar cyclic voltammetries keeping the oxidation and reduction peaks at the same potential and the same peak height.

Figure 3:
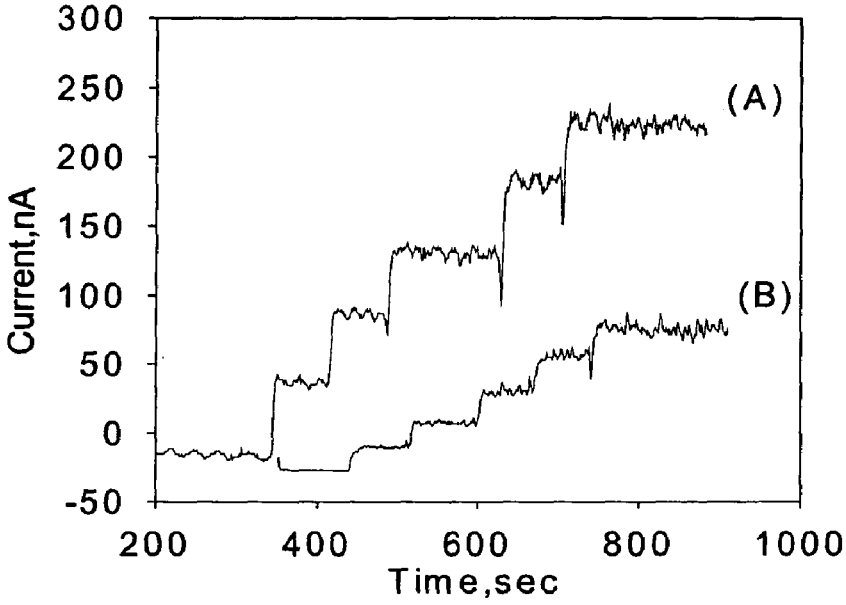
FIG. 3 presents comparative plots illustrating a representative amperometric (I to t) response of 10 mM $K_4[Fe(CN)_6]$ in a screen-printed electrochemical cell at 200 mV, obtained by an electrochemical cell modified with peptide nanotubes (A) and without any modification (B)

Chronoamperometry was used to further explore the effect of the nanotubes deposition on the electrochemical process (FIG. 3). The experiments were carried out under diffusion controlled potential (200 mV vs. Ag/AgCl). This potential is more positive than the oxidation peak observed in cyclic voltammetry experiments shown in FIGS. 2*a-b*. The amperometric response of the PNT modified electrode (A) and non-modified electrode (B) were compared under continuous stirring of the solution and successive additions of $K_4[Fe(CN)_6]$. Following addition of an aliquot of $K_4[Fe(CN)_6]$ to the KCl 0.1M solution, the amperometric response of the modified electrode (A) is significantly higher (about 2.5 fold increase) than that of the non-modified electrode (B).

Detection of hydrogen peroxide is becoming of practical importance in the assay of oxidoreductase substrates such as glucose, lactate, choline, and cholesterol because sensitive measurement of enzymatically formed hydrogen peroxide is necessary for the development of many enzyme electrodes for clinical and environmental applications.

Figure 4:
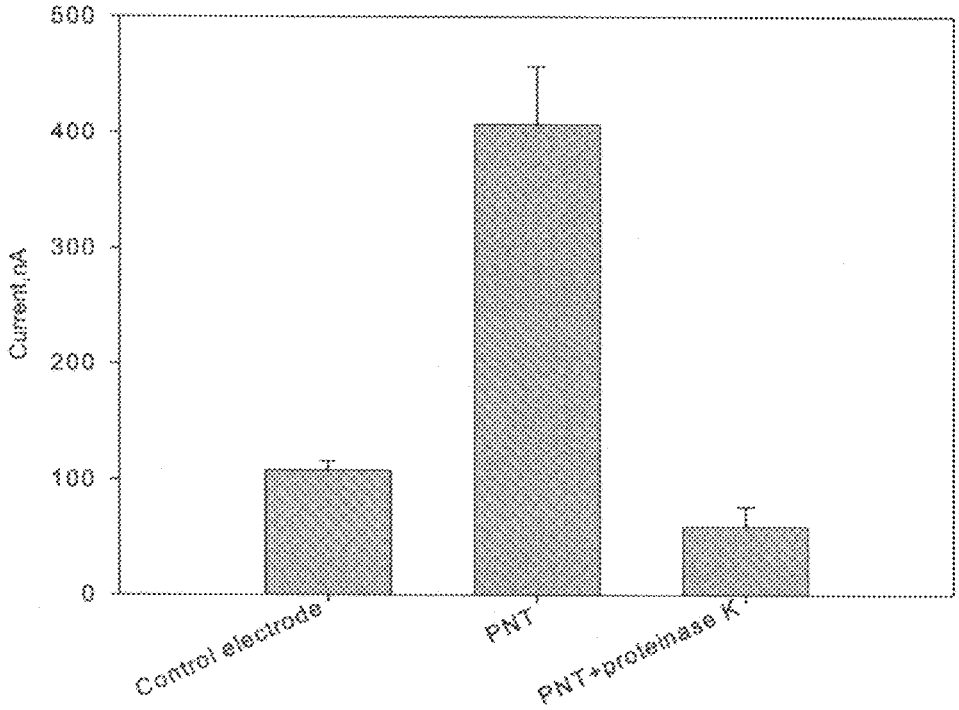
FIG. 4 presents a bar graph illustrating an amperometric response to 1 mM 4-Acetamidophenol and 0.75 mg/ml horseradish peroxidase and 1 mM hydrogen peroxide of a control electrode, a peptide nanotube electrode (PNT) and a peptide nanotube electrode exposed to Proteinase K (each bar represents 4 independent experiments; the 10 ml cell contains 0.1M phosphate buffer (pH 5.8) with the addition of 0.1M KCl; applied potential: −50 mV; time of detection: 15 seconds)

Thus, the present inventors explored the detection potential of PNT-modified electrode properties by measuring hydrogen peroxide, using peroxidase and 4-acetaminophenol as mediator (Vansteveninck et al 1989). The current-time amperometric curve was recorded under contentious stirring of the solution, and the current was plotted for each electrode. FIG. 4 presents the response of a PNT-modified electrode to hydrogen peroxide; bare electrode, and a proteinase K degraded PNT-coated served as controls. The addition of hydrogen peroxide clearly demonstrates a lower response for both control electrodes as compared to the PNT-coated electrode.

Scanning electron microscopy (SEM) was used to characterize the ultrastructure of the peptide nanotubes on the electrode surface (FIGS. 5*a-c*). While no ordered structures could be observed in a SEM image of a control electrode (FIG. 5*a*), an array of elongated nanotubular structures of remarkable persistent length was observed on the PNT-deposited electrode (FIG. 5*b*). The ultrastructural morphology of the peptide structures on the electrode surface is consistent with previously described peptide assemblies. Since these nanostructures were also observed on the electrode following electrochemical experiments, there is clear evidence that the tubular structures remained attached to the modified working electrode. Following application of a proteolytic enzyme (Proteinase K), no tubular structures were observed (FIG. 5*c*), clearly illustrating the efficiency of the proteolytic process. It should be noted that the lower electrochemical activity observed for the Proteinase K treated electrode as compared with the uncoated electrode might be due to residual amino acids which contaminate the electrode surface.

Example 2

Fabrication and Practice of a Peptide Nanotube-Coated Electrode Co-Coated with GOx Materials:

Hydrogen peroxide solution 30% ($H_2O_2$), KCl, $K_2HPO_4$ and $KH_2PO_4$ were obtained from Merck. Purified glucose oxidase (GOx) from *Aspergillus niger*, b-D-glucose, NADH (b-nicotinamide adenine dinucleotide, reduced form), NAD+, alcohol dehydrogenase (ADH) and polyethyleneimine (PEI) were purchased from Sigma. Phe-Phe peptides were purchase from Bachem. Glutaraldehyde solution was obtained from Fluka. All solutions were prepared using double distilled water.

Preparation of Peptide Nanotubes:

Fresh stock solutions were prepared by dissolving lyophilized peptides in 1,1,1,3,3,3-hexafluoro-2-propanol at a concentration of 100 mg/ml. To avoid any pre-aggregation, fresh stock solutions were prepared for each experiment. The assembly of the peptide nanotubes was performed at the optimal concentration of 2 mg/ml.

Thiol modification: after one day incubation at room temperature, 10 μl of 100 mg/ml 2-iminothiolane (Sigma) dissolved in dimethyl sulfoxide (DMSO) with 2% N,N-diisopropylethylamine (DIAE) was added to 90 μl peptide nanotubes solution. This resulted in the modification of the terminal amines of the peptide nanotubes into thiols that allowed the attachment of the nanotubes to the electrode via thiol-gold interaction.

Electrochemical Cell:

A 15 ml glass electrochemical cell containing three electrodes was used in the following experiments. The working electrode was a gold disk electrode (1 mm in diameter) embedded in Teflon, a platinum wire counter electrode and a saturated calomel electrode (SCE) were used as reference electrodes. Prior to use, the gold electrodes were polished with 0.5 mm alumina and washed with double-distilled water and then immersed in a sonicator bath for 20 minutes, followed by washing in double-distilled water.

Measurements:

An EG & G potentiostat interfaced to PC computer system with PAR M270 software was used for recording. Chronoamperometric experiments with hydrogen peroxide and NADH were conducted at constant applied potential +0.4 V in KCl 0.1 M solution and measurements of glucose and ethanol were conducted at constant potential of +0.6 V in a phosphate buffer solution. The solution was stirred during the chronoamperometric experiments at a constant speed of 100 rpm using a magnetic stirrer. All experiments were carried out at room temperature.

Preparation of a Peptide Nanotube-Coated Electrode Co-Coated with GOx:

Electrodes for detecting hydrogen peroxide, NADH and ethanol, were prepared by depositing an aliquot (2 ml) of thiol modified peptide nanotubes solution on the surface of working electrode and allowing the solution to dry at room temperature for 90 minutes.

Electrodes for detecting glucose were prepared by mixing 2 ml of the thiol modified peptide nanotubes with 1 mM of GOx in the presence of 0.25% glutaraldehyde and 0.05% polyethyleneimine (PEI), depositing the resulting enzyme coated peptide nanotubes on the gold electrode surface and drying it at room temperature for 90 minutes.

Scanning Electron Microscopy:

Modified electrodes were coated with gold. Scanning electron microscopy images were captured using a JSM JEOL 6300 SEM operating at 5 kV.

Results:

The electrochemical behavior of PNT-based sensor of the present invention was tested in the presence of hydrogen peroxide and NADH since detection of these molecules is central to a wide range of biosensing applications.

Direct Detection of Hydrogen Peroxide:

The response to hydrogen peroxide of a peptide nanotube based electrode and a bare (unmodified) gold electrode was tested. FIG. 6 depicts the average response of these electrodes at three applied potentials. It is evident that the PNT-coated electrodes (Bars 1-3) exhibit much higher response currents than the uncoated electrodes (Bars 4-6). The anodic response current of the PNT based electrode to the addition of 10 mM hydrogen peroxide at +0.6 V vs. SCE (Bar 1), was 3.5 times higher than that of the unmodified electrode at the same applied potential (Bar 4). At lower potential (+0.4 V vs. SCE), a response of 100 nA was obtained for the modified electrodes whereas no significant response was obtained for the bare electrodes. At 0.15 V vs. SCE no activity was observed for both electrodes. These findings demonstrate the higher electrochemical reactivity of peptide nanotube electrodes. This activity can be explained by a direct electron transfer between spatially aligned aromatic systems that contribute to the electronic conductivity of these PNT assemblies (Yemini et al. 2005).

Figure 7:
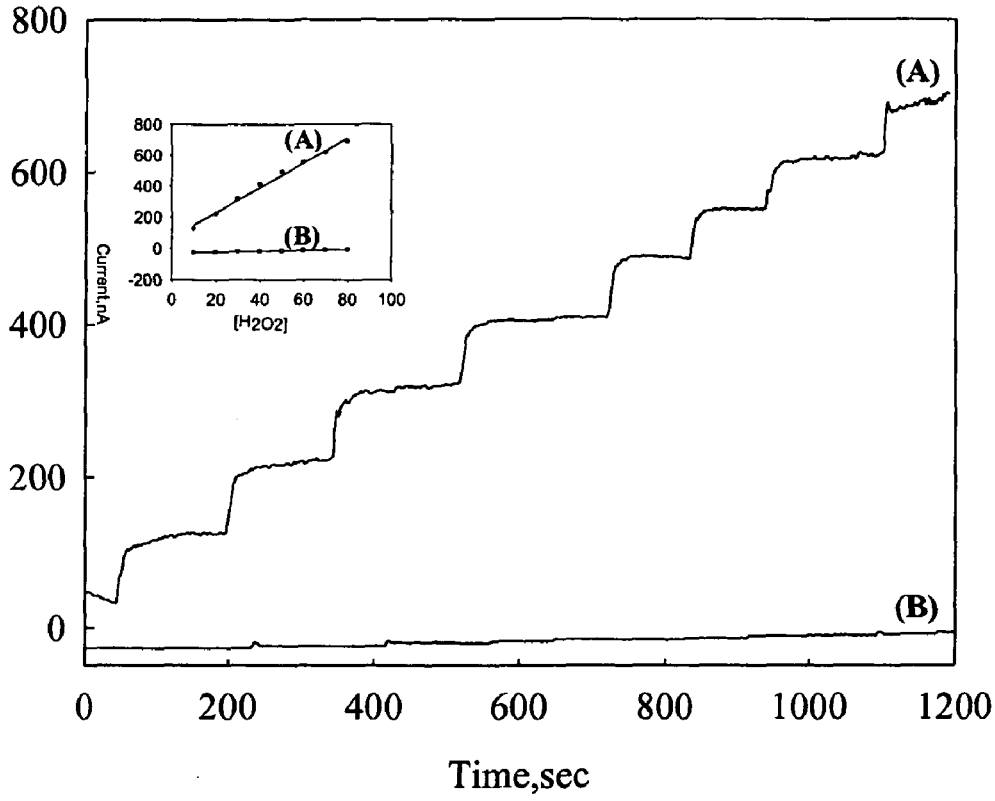
FIG. 7 presents a plot illustrating amperometric response of a PNT-coated electrode (A) and a bare (unmodified) electrode (B) to successive additions of 10 mM $H_2O_2$ at +0.4 V vs SCE.

FIG. 7 compares the amperometric response at 0.4 V of the gold working electrode to successive additions of hydrogen peroxide with resulting calibration plots. As expected, the uncoated electrode did not respond to hydrogen peroxide additions, while the PNT coated electrode responded very rapidly producing steady-state signals within less than 5 seconds.

Detection of NADH:

Fast and reliable detection of NADH at low potentials is of particular importance since NADH is a key component in dehydrogenase based amperometric biosensors such as alcohol dehydrogenase, lactate dehydrogenase and malate dehydrogenase.

Figure 8A:
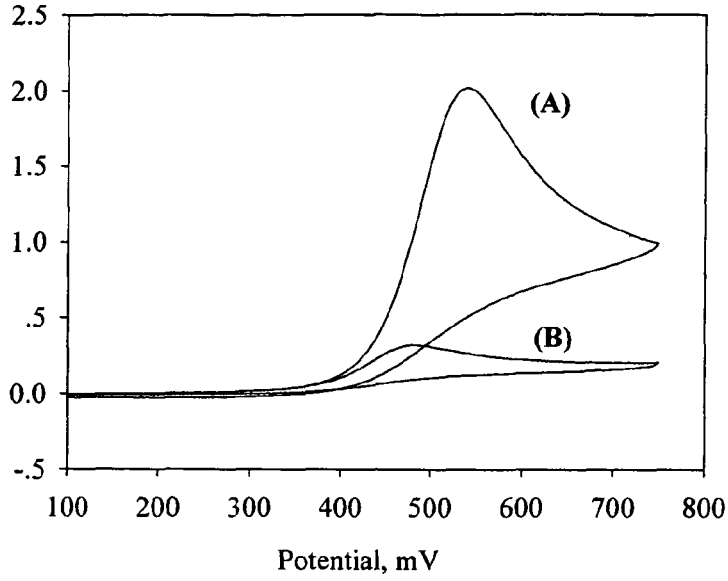
FIGS. 8*a-b* present comparative plots illustrating cyclic voltammetric measurements of a peptide nanotube-coated electrode (A) and a control (unmodified) electrode (B) measured in a solution containing 50 mM NADH (FIG. 8*a*) and the amperometric response at +0.4 V of the peptide nanotube-coated electrode and the control electrode to successive additions of NADH (Scan rate: 50 mV/sec)
Figure 8B:
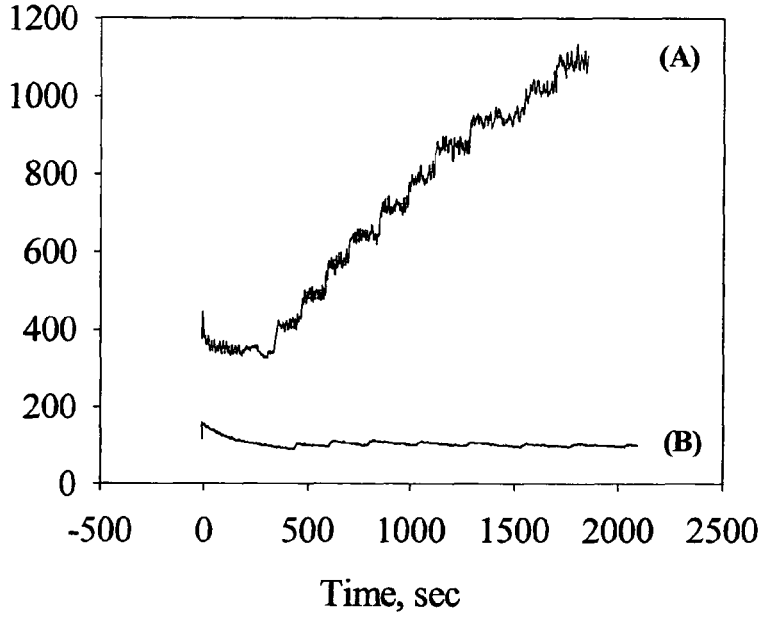

FIG. 8*a* presents cyclic voltammetries of a PNT-coated electrode in a solution containing 50 mM NADH in comparison to an uncoated electrode. The cyclic voltammograms of the peptide nanotube based electrode and control electrode clearly demonstrate that the presence of peptide nanotubes significantly improved the sensitivity of the electrode. FIG. 8*b* compares the amperometric response at +0.4 V of the PNT-coated gold electrode and the uncoated gold electrode to successive additions of NADH. As expected from the voltammetric data, the uncoated gold electrode shows almost no response to concentration changes while the PNT-coated electrode responds significantly and rapidly to the changes of NADH concentration.

The attractive low-potential detection of hydrogen peroxide and NADH, along with the apparent functional surface-area extension, makes peptide nanotubes extremely attractive for amperometric biosensing using various enzymes.

Figure 9A:
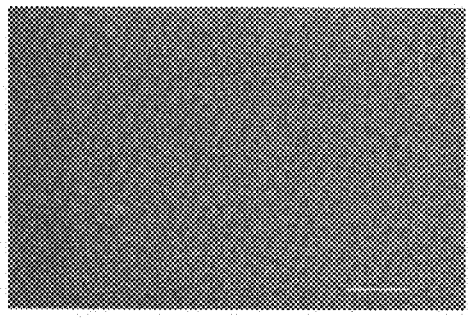
FIGS. 9*a-b* present scanning electron microscope images (scale bar—1 mm) of control unmodified gold electrode (FIG. 9*a*) and an enzyme-containing peptide nanotube-coated (modified) electrode (FIG. 9*b*)
Figure 9B:
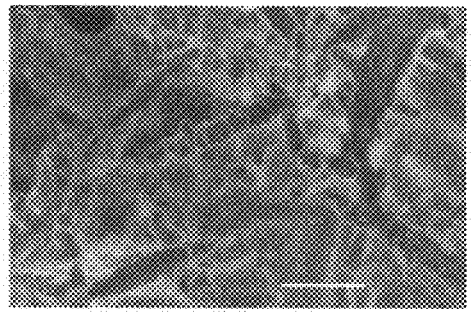

SEM microscopy was employed to gain insight into the nature of the enzyme modified peptide nanotube based gold electrodes. FIGS. 9*a*-*b* show the SEM image for gold electrodes with immobilized enzyme modified peptide nanotubes in comparison to bare gold electrode. An array, composed of elongated nanotubular structures, was observed on the PNT-coated electrode (FIG. 9*b*), while no tubular structures were observed on the surface of the uncoated gold electrode (FIG. 9*a*).

Detection of β-D-Glucose:

Electro-enzymatic detection of glucose was effected by using a novel biosensor which was fabricated by cross linking the enzyme glucose oxidase (GOx) to the peptide nanotubes. GOx modified peptide nanotubes were immobilized on the gold electrode through thiol moieties displayed on the nanotubes.

Figures 10A, 10B, 10C:
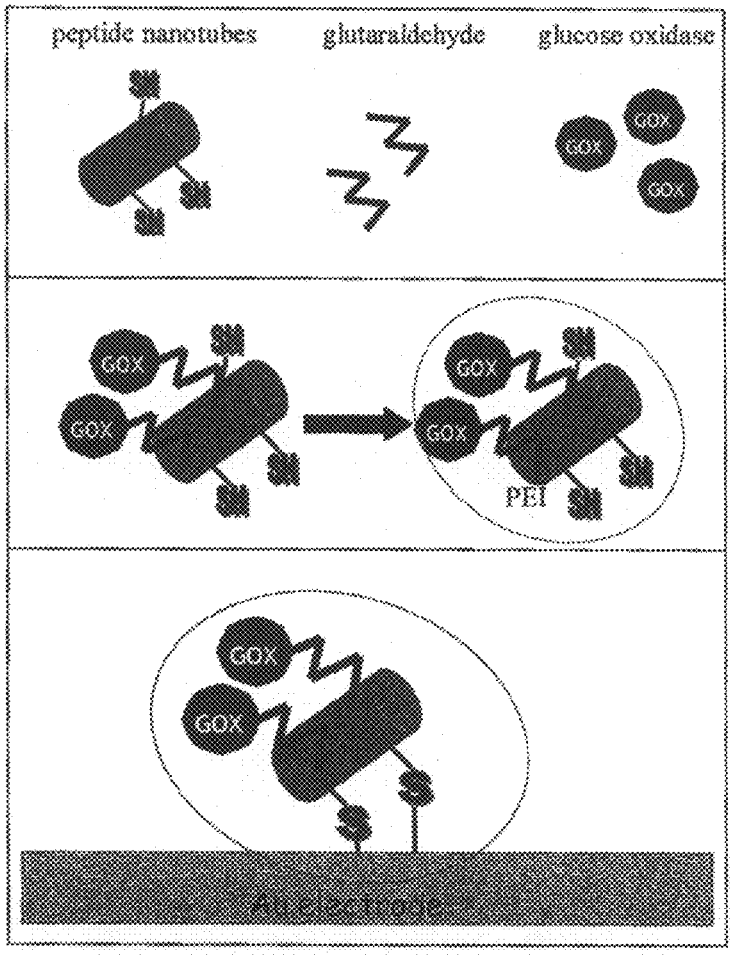
FIG. 10 schematically illustrates fabrication of a peptide nanotube-coated enzymatic electrode, effected by mixing thiol modified peptide nanotubes with 1 mM of GOx in the presence of 0.25% glutaraldehyde (A); adding 0.05% PEI to the solution (B); and depositing the resulting enzyme coated peptide nanotubes on the gold electrode surface, followed by drying at room temperature (drawing not to scale); and (C)—The resulted enzyme coated peptide nanotubes were deposited on the gold electrode surface and dried at room temperature (drawing not to scale)

FIG. 10 schematically depicts construction of such a peptide nanotube based biosensor. GOx was incorporated into the three-dimensional electrode matrix which includes the PEI layer; the modified peptide nanotubes were attached through thiol modification to the gold electrode surface. Control electrodes included the same immobilization matrix (GOx in PEI), but were devoid of peptide nanotubes.

Figure 11:
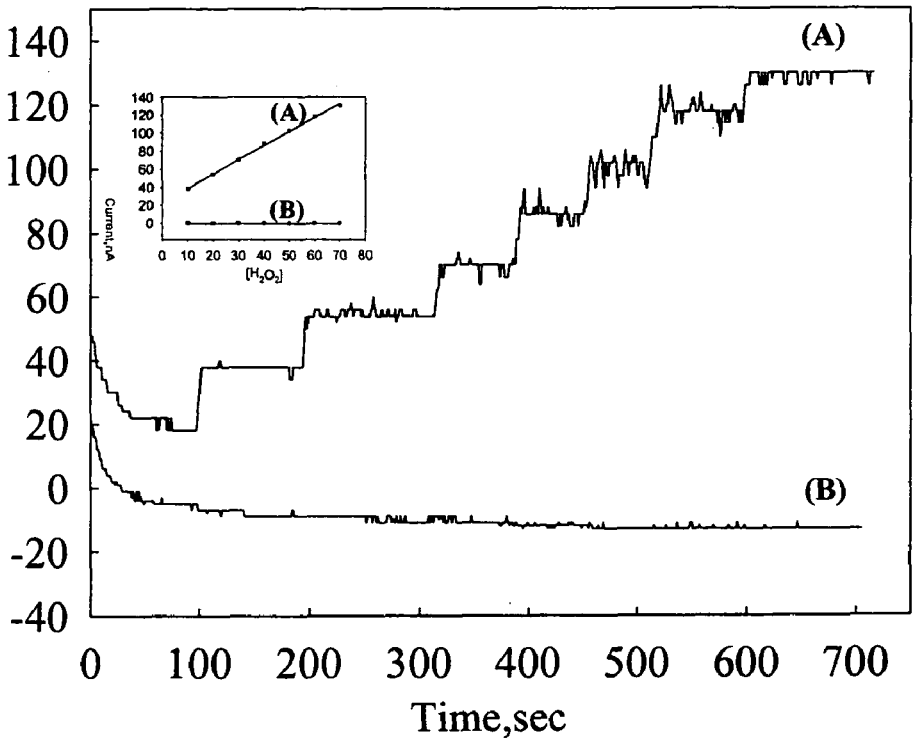
FIG. 11 presents comparative plots illustrating amperometric response to successive additions of 0.2 mM b-D-glucose, measured at 0.6 V vs. SCE for glucose oxidase- and peptide nanotubes-coated electrode (A) and glucose oxidase (no nanotubes) electrode (B) in 0.1 M phosphate buffer solution, 0.1 M KCl, pH 7.5.

FIG. 11 compares the amperometric response of the PNT electrode and the control electrode to successive additions of 0.2 mM glucose. The anodic current of the PNT electrode increased immediately following addition of glucose and reached a steady state in a few seconds. Control experiments show no response to glucose, confirming the contribution of the peptide nanotubes to detection sensitivity.

Figure 12:
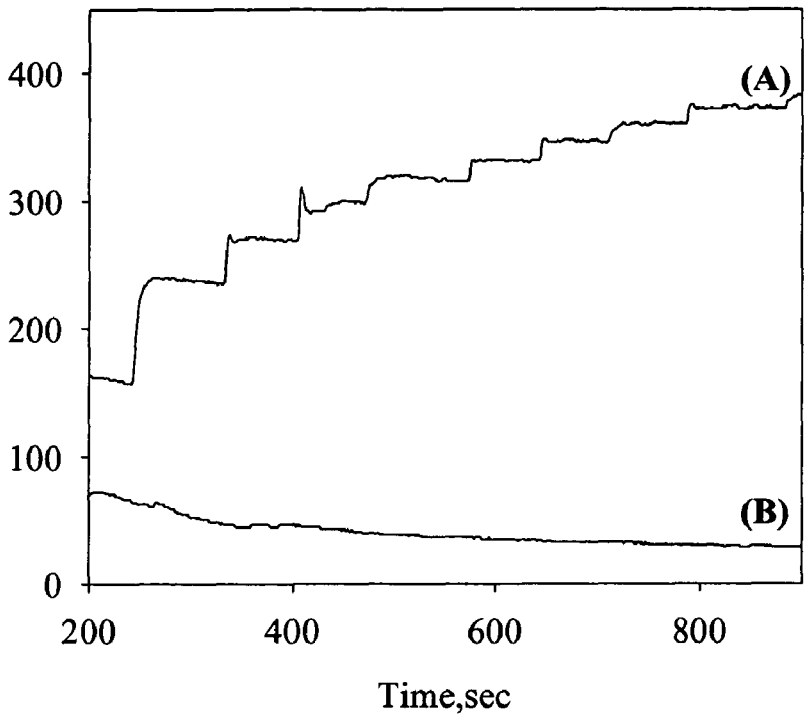
FIG. 12 presents comparative plots illustrating the amperometric response of a peptide nanotube based electrode (A) and unmodified electrode (B) to successive additions of 20 mM ethanol in 0.1 M phosphate buffer solution with 0.1 M KCl, pH 8 contains 0.2 mM $NAD^+$ and 30 mU ADH.

Detection of Ethanol:

FIG. 12 shows typical dynamic amperometric response of a PNT coated electrode and a control electrode to successive additions of 20 mM ethanol into the electrochemical cell containing 0.2 mM $NAD^+$ and 30 mU of alcohol dehydrogenase (ADH) in phosphate buffer pH 8 solution. The oxidation of ethanol by ADH proceeds as follows:

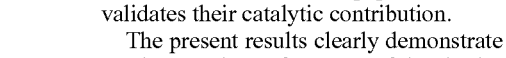

$$CH_3CH_2OH+NAD^+ \rightarrow CH_3CHO+NADH+H^+$$

As shown, the current changes were insignificant in the control experiments with the uncoated electrodes. The large current obtained with the peptide nanotube based electrode validates their catalytic contribution.

The present results clearly demonstrate the effect of PNT coatings on the performance of simple electrodes. Significant enhancements in sensitivity were demonstrated by both cyclic voltammetric and time-based amperometric techniques. PNT-coated electrodes show improved electrochemical characteristics as demonstrated by hydrogen peroxide and NADH detection. The modified electrodes exhibit non-mediated electron transfer, short detection time, large current density and comparatively high stability. The PNT-coated electrodes of the present invention exhibited excellent sensitivity and reproducibility for determination of glucose and ethanol by electrocatalytic oxidation of enzymatically liberated hydrogen peroxide and NADH respectively.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications and GenBank Accession numbers mentioned in this specification are herein incorporated in their entirety by reference into the specification, to the same extent as if each individual publication, patent or patent application or GenBank Accession number was specifically and individually indicated to be incorporated herein by reference. In addition, citation or identification of any reference in this application shall not be construed as an admission that such reference is available as prior art to the present invention.

REFERENCES

Aggeli, A.; Fytas, G.; Vlassopoulos, D.; McLeish, T. C.; Mawer, P. J.; Boden, N. *Biomacromolecules* 2001, 2, 378-388.

Baugmann, R H.; Chang, X. C.; Zakhidov, A. A.; Iqbal, Z.; Barisci, J. N.; Sprinks, G. G.; Wallace, G. G.; Mazzoldi, A.; Rossi, D.; Rinzler, A. G.; Jaschinski, O.; Roth, S.; Kertesz, M. *Science* 1999, 284, 1340.

Baugmann, R. H.; Zakhidov, A. A.; de Heer, W. A. *Science* 2002, 297, 787-792.

Baxendale, M. *J. Mater. Sci. Mater. Electron.* 2003, 14, 657-659.

Besteman, K.; Lee, J. O.; Wiertz, F. G. M.; Heering, H. A.; Dekker, C. *Nano Lett* 2003, 3, 727-730.

Bong, D. T.; Clark, T. D.; Granja, J. R.; Ghadiri, M. R. Angew. *Chem. Int. Ed. Engl.* 2001, 40, 988.

Chen, R. J.; Zhan, Y. G.; Wang, D. W.; Dai, H. J. *J. Am. Chem. Soc.* 2001, 123, 3838-3839.

Delvaux, M.; Demoustier-Champange, S. *Biosens. Bioelectron.* 2003, 18, 943-951.

Djalali, R.; Chen, Y. F.; Matsui, H. *J. Am. Chem. Soc.* 2003, 125, 5873.

Gao, M.; Dai, L.; Wallace, G. G. *Electroanalysis* 2002, 15, 1089-1094.

Gazit, E. A possible role for p-stacking in the self-assembly of amyloid fibrils. *FASEB J.* 16, 77-83 (2002).

Eshkenazi, I.; Maltz, E.; Zion, B.; Rishpon, J. *J. Dairy Sci.* 2000, 83, 1939-1945.

Hartgerink, J. D., Beniash, E. & Stupp, S. I. Self-assembly and mineralization of peptide-amphiphile nanofibers. *Science* 294, 1684-1688 (2001).

Hrapovic, S.; Lui, Y.; Male, K. B.; Luong, J. H. *Anal Chem* 2004, 76, 1083-1088.

Kawai, T. *J. Biosci. Bioeng.* 2004, 97, 29-32.

Kong, J.; Franklin, N. R.; Zhou, C. W.; Chapline, M. G.; Peng, S.; Cho, K. J.; Dai, H. J. *Science* 2000, 287, 622-625.

Lee, S. W., Mao, C., Flynn, C. E. & Belcher, A. M. Ordering of quantum dots using genetically engineered viruses. *Science* 296, 892-895 (2002).

Lin, Y. H.; Lu, F.; Tu, Y.; Ren, Z. F. *Nano Lett* 2004, 4, 191-195.

Nelson, S. D., Dahlin, D. C., Rauckman, E. J. & Rosen, G. M. Peroxidase-mediated formation of reactive metabolites of acetarinnophen. *Mol Pharmacol* 20, 195-199 (1981).

Park, J. W.; Lee, H. Y.; Kim. J. M.; Yamasaki, R.; Kanno, T.; Tanaka, K.; Tanaka, H.; Oxidation of Paracetamol. *Biochem. J.* 259, 633-637 (1989).

Radmacher, M.; Tilmann, R W.; Fritz, M.; Gaub, H. E. *Science* 1992, 257, 1900.

Reches, M.; Gazit, E. *Science* 2003, 300, 625-627.

Reches. M.; Gazit, E. *Nano Lett.* 2004, 4, 581-585.

Rishpon, J.; Ivnitski, D. *Biosens Bioelectron* 1997, 12, 195-204.

Song, Y. J.; Challa, S. R.; Medforth, C. J.; Qiu, Y.; Watt, R. K.; Pena, D.; Miller, J. E.; van Swol, F.; Shelnutt, J. A. *Chem. Commun.,* 2004 9, 1044.

Vansteveninck, J., Koster, J. F. & Dubbelman, T. Xanthine Oxidase-Catalyzed

Wang, J.; Musameh, M. *Anal. Chem* 2003, 75, 2075-2079.

Wong, S. S.; Joselevich, E.; Wooley, A. T.; Cheung, C. L.; Leiber, C. M. *Nature* 1998, 394, 54-55.

Yemini, M.; Reches, M.; Rishpon, J.; Gazit, E. *Nano Lett* 2005, 5, 183-186.

Zhang S. *Nat. Biotechnol.* 2003, 21, 1171.

Zhang, S. Fabrication of novel biomaterials through molecular self-assembly. *Nat Biotechnol* 21, 1171-1178 (2003).

What is claimed is:

1. An electrode comprising a plurality of peptide nanostructures, said peptide nanostructures being composed of a plurality of peptides self-assembled into said peptide nano structures, the electrode being capable of conducting a response current resulting from an electrochemical reaction in a proximity thereof, wherein each of said peptides in said plurality of peptides comprises at least one aromatic amino acid residue; and wherein at least one peptide in said plurality of peptides consists essentially of aromatic amino acid residues.

2. The electrode of claim 1, further comprising a support having a surface, said peptide nanostructures being attached to said surface.

3. The electrode of claim 2, wherein each of said peptide nanostructures is attached to said surface via interactions selected from the group consisting of hydrogen bond interactions, hydrophobic interactions, covalent interactions, coordinative interactions, electrostatic interactions and surface interactions.

4. The electrode of claim 3, wherein at least one peptide in said plurality of peptides forming said peptide nanostructures comprises a functional group for forming said interactions with said surface.

5. The electrode of claim 1, wherein each of said peptides in said plurality of peptides comprises from 2 to 15 amino acid residues.

6. The electrode of claim 1, wherein each of said peptides in said plurality of peptides comprises from 2 to 7 amino acid residues.

7. The electrode of claim 1, wherein at least one peptide in said plurality of peptides is an end-capping modified peptide.

8. The electrode of claim 1, further comprising a moiety being capable of generating an electrochemically reactive molecule and/or capable of reacting with and/or capturing a molecule generating an electrochemically reactive molecule upon said electrochemical reaction.

9. An electrochemical cell comprising a working electrode and a reference electrode, said working electrode being the electrode of claim 8.

10. A process of preparing the electrode of claim 1, the process comprising subjecting said plurality of peptides to conditions which favor formation of said peptide nanostructures.

11. The process of claim 10, wherein said electrode further comprises a support having a surface coated with said peptide nanostructures, the process further comprising:

attaching said peptide nanostructures to said surface.

12. The process of claim 11, further comprising, prior to said attaching:

modifying said peptide nanostructures to thereby generate a functional group thereon, said functional group being for attaching said peptide nanostructures to said surface.

13. The process of claim 10, further comprising, prior to, concomitant with or subsequent to said subjecting, attaching to or encapsulating in said peptide nanostructures a moiety capable of generating an electrochemically reactive molecule and/or capable of reacting with and/or capturing a molecule generating said electrochemically reactive molecule upon said electrochemical reaction.

14. An electrochemical cell comprising a working electrode and a reference electrode, said working electrode being the electrode of claim 1.

15. The electrochemical cell of claim 14, further comprising an auxiliary electrode.

16. The electrochemical cell of claim 14, further comprising an auxiliary electrode.

17. The electrochemical cell of claim 14, further comprising a moiety being capable of generating an electrochemically reactive molecule and/or capable of reacting with and/or capturing a molecule generating said electrochemically reactive molecule upon said electrochemical reaction.

18. The electrochemical cell of claim 17, wherein said moiety is attached to or encapsulated in said peptide nanostructures.

19. A detector comprising:

(a) the electrode of claim 1; and (b) a detecting unit attached to said electrode and being capable of detecting a response current resulting from said electrochemical reaction.

20. The detector of claim 19, further comprising a reference electrode.

21. The detector of claim 20, further comprising an auxiliary electrode.

22. The detector of claim 19, further comprising a moiety being capable of generating an electrochemically reactive molecule and/or capable of reacting with and/or capturing a molecule generating said electrochemically reactive molecule upon said electrochemical reaction.

23. The detector of claim 22, wherein said moiety forms a part of a first member of a binding pair and said molecule generating said electrochemically reactive molecule forms a part of a second member of a binding pair.

24. The detector of claim 19, wherein said moiety is a ligand, said ligand being capable of capturing a molecule generating said electrochemically active molecule.

25. The detector of claim 24, wherein said ligand is attached to or encapsulated in said peptide nanostructures.

26. A method of electrochemically detecting an analyte is a sample, the method comprising:

contacting the sample with the detector of claim 19; and measuring said response current.

27. The method of claim 26, wherein the analyte is an electrochemically reactive molecule.

28. The method of claim 26, wherein the analyte forms a part of a first member of a binding pair and said detector further comprises a second member of said binding pair.

29. The method of claim 28, wherein said contacting generates an electrochemically reactive molecule upon interaction between said first and said second members of said binding pairs.

30. The method of claim 28, wherein said second member of said binding pair is attached to or encapsulated in said peptide nanostructures.

31. The method of claim 19, wherein the analyte generates an electrochemically reactive molecule.

32. A kit for detecting an analyte in a sample, the kit comprising the detector of claim 19 being packaged in a packaging material and identified in print, in or on said packaging material, for use in detecting the analyte.

33. The kit of claim 32, wherein the analyte is an electrochemically reactive molecule.

34. The kit of claim 32, wherein the analyte generates an electrochemically reactive moiety.

35. The kit of claim 32, wherein the analyte forms a part of a first member of a binding pair and said detector further comprises a second member of said binding pair.

36. The kit of claim 35, wherein said contacting produces an electrochemically reactive molecule upon interaction between said first and said second members of said binding pairs.

37. The kit of claim 35, wherein said second member of said binding pair is attached to or encapsulated in said peptide nanostructures.

38. The kit of claim 35, wherein said detector and said second member of said binding pair are individually packaged within the kit.

39. A detector comprising:

(a) the electrode of claim 1;

(b) a detecting unit attached to said electrode and being capable of detecting a response current resulting from said electrochemical reaction; and (c) a moiety being capable of generating an electrochemically reactive molecule and/or capable of reacting with and/or capturing a molecule generating said electrochemically reactive molecule upon said electrochemical reaction, wherein said moiety is an enzyme, said enzyme being capable of catalyzing a reaction generating said electrochemically reactive molecule.

40. The detector of claim 39, wherein said enzyme is attached to or encapsulated in said peptide nano structures.

41. A sensor array comprising a plurality of electrochemical cells each comprising, as a working electrode, the electrode of claim 1.

42. The sensor array of claim 41, wherein each of said plurality of electrochemical cells further includes a reference electrode.

43. The sensor array of claim 42, wherein each of said plurality of electrochemical cells further includes an auxiliary electrode.

44. The sensor array of claim 41, wherein the sensor array includes a support having a plurality of chambers, and whereas each of said plurality of electrochemical cells is disposed within a specific chamber of said plurality of chambers.

45. An electrode comprising a plurality of peptide nanostructures, said peptide nanostructures being composed of a plurality of peptides self-assembled into said peptide nano structures, the electrode being capable of conducting a response current resulting from an electrochemical reaction in a proximity thereof, wherein each of said peptides in said plurality of peptides comprises from 2 to 15 amino acid residues; and wherein at least one peptide in said plurality of peptides is a dipeptide.

46. The electrode of claim 45, wherein each peptide in said plurality of peptides is a phenylalanine-phenylalanine dipeptide.

47. An electrode comprising a plurality of peptide nanostructures, said peptide nanostructures being composed of a plurality of peptides self-assembled into said peptide nano structures, the electrode being capable of conducting a response current resulting from an electrochemical reaction in a proximity thereof, the electrode comprising a moiety being capable of generating an electrochemically reactive molecule and/or capable of reacting with and/or capturing a molecule generating an electrochemically reactive molecule upon said electrochemical reaction; wherein said moiety is an enzyme, said enzyme being capable of catalyzing a reaction generating said electrochemically reactive molecule.

48. An electrode comprising a plurality of peptide nanostructures, said peptide nanostructures being composed of a plurality of peptides self-assembled into said peptide nano structures, the electrode being capable of conducting a response current resulting from an electrochemical reaction in a proximity thereof, the electrode comprising a moiety being capable of generating an electrochemically reactive molecule and/or capable of reacting with and/or capturing a molecule generating an electrochemically reactive molecule upon said electrochemical reaction; wherein said moiety is a ligand, said ligand being capable of capturing said molecule generating said electrochemically reactive molecule.

* * * * *